US010899511B2

(12) United States Patent
Showering

(10) Patent No.: US 10,899,511 B2
(45) Date of Patent: Jan. 26, 2021

(54) CONTAINER CLOSURE

(71) Applicant: Francis Showering, Hampshire (GB)

(72) Inventor: Francis Showering, Hampshire (GB)

( * ) Notice: Subject to any disclaimer, the term of this patent is extended or adjusted under 35 U.S.C. 154(b) by 371 days.

(21) Appl. No.: 15/573,421

(22) PCT Filed: May 10, 2016

(86) PCT No.: PCT/EP2016/060362
§ 371 (c)(1),
(2) Date: Nov. 10, 2017

(87) PCT Pub. No.: WO2016/180795
PCT Pub. Date: Nov. 17, 2016

(65) Prior Publication Data

US 2018/0111727 A1 Apr. 26, 2018

(30) Foreign Application Priority Data

May 10, 2015 (GB) ..... 1507951

(51) Int. Cl.
*B65D 51/14* (2006.01)
*B65D 43/02* (2006.01)
(Continued)

(52) U.S. Cl.
CPC ..... *B65D 51/145* (2013.01); *B65D 43/0262* (2013.01); *B65D 43/0283* (2013.01);
(Continued)

(58) Field of Classification Search
CPC ..... B65D 51/145; B65D 51/1677; B65D 51/1672; B65D 43/0283; B65D 43/0262;
(Continued)

(56) References Cited

U.S. PATENT DOCUMENTS 3,407,957 A * 10/1968 Robinson ..... B65D 47/36 215/251
3,561,637 A * 2/1971 McConnell ..... B65D 45/32 220/320
3,603,472 A * 9/1971 Lecinski, Jr. ..... B65D 41/08 215/253
3,746,199 A * 7/1973 Hart ..... B65D 41/08 215/256
4,699,287 A * 10/1987 Bullock ..... B65D 41/48 215/256
(Continued)

FOREIGN PATENT DOCUMENTS

WO WO 97/11005 A1 3/1997
WO WO 00/69741 A1 11/2000
(Continued)

*Primary Examiner* — Chun Hoi Cheung
*Assistant Examiner* — Brijesh V. Patel
(74) *Attorney, Agent, or Firm* — Cooley LLP

(57) ABSTRACT

Closure for a container mouth, the closure comprising: a cover portion (18) for covering at least a portion of the container mouth; a fastener portion (20) for engaging the container for fastening the closure to the container; and a peelable bracing portion (22) extending generally in a circumferential direction of or around an axis of the closure, the bracing portion overlapping at least partly the cover portion and the fastener portion, and configured to reinforce the closure by bearing, as shear stress at an interface between the bracing portion and at least one of the cover portion and fastener portion, support force in or between one or both of the cover portion and the fastener portion.

18 Claims, 18 Drawing Sheets

(51) Int. Cl.
*B65D 51/16* (2006.01)
*B67B 5/03* (2006.01)

(52) U.S. Cl.
CPC ..... *B65D 51/1672* (2013.01); *B65D 51/1677* (2013.01); *B67B 5/036* (2013.01); *B65D 2205/00* (2013.01); *B65D 2401/20* (2020.05); *B65D 2401/25* (2020.05); *B65D 2401/30* (2020.05); *B65D 2401/50* (2020.05); *B65D 2401/55* (2020.05); *B65D 2543/0024* (2013.01); *B65D 2543/0074* (2013.01); *B65D 2543/00092* (2013.01); *B65D 2543/00296* (2013.01); *B65D 2543/00314* (2013.01); *B65D 2543/00537* (2013.01); *B65D 2543/00629* (2013.01); *B65D 2543/00685* (2013.01); *B65D 2543/00796* (2013.01); *B65D 2543/00842* (2013.01); *B65D 2543/00981* (2013.01)

(58) Field of Classification Search
CPC ..... B65D 2543/00796; B65D 2543/00842; B65D 2543/0074; B65D 2543/00685; B65D 2543/00629; B65D 2543/00537; B65D 2543/00314; B65D 2543/00296; B65D 2543/0024; B65D 2543/00092; B65D 2543/00981; B65D 2101/0076; B65D 2101/0084; B65D 2101/0038; B65D 2101/003; B65D 2101/0046; B65D 2205/00; B67B 5/036
USPC .... 220/265–267, 269, 366.1, 372, 371, 368, 220/367.1; 229/200–249; 215/256, 335, 215/44, 329, 344, 11.5, 251
See application file for complete search history.

(56) References Cited

U.S. PATENT DOCUMENTS

| | | | | |
|---|---|---|---|---|
| 4,880,138 | A | 11/1989 | Pfeiffer et al. | |
| 5,785,198 | A * | 7/1998 | Credle, Jr. | B65D 45/305 220/254.8 |
| 6,105,807 | A * | 8/2000 | McCrossen | B65D 21/022 220/288 |
| 7,090,088 | B2 * | 8/2006 | von Holdt, Jr. | B65D 21/0233 220/266 |
| 8,132,685 | B2 * | 3/2012 | Wellman | B65D 41/3495 215/344 |
| 8,550,268 | B1 | 10/2013 | Chisholm | |
| 8,556,096 | B2 * | 10/2013 | Parmaningsih | B29C 45/0081 215/256 |
| 2008/0257848 | A1 * | 10/2008 | Farrar | B65D 41/065 215/44 |
| 2008/0308519 | A1 * | 12/2008 | Farrar | B65D 45/325 215/329 |
| 2012/0037587 | A1 * | 2/2012 | Tirosh | A61J 9/04 215/11.5 |
| 2012/0103849 | A1 | 5/2012 | Rachuk et al. | |
| 2014/0076889 | A1 * | 3/2014 | Stolzman | B65D 15/08 220/1.5 |
| 2017/0137189 | A1 * | 5/2017 | McPherson | B65D 41/34 |

FOREIGN PATENT DOCUMENTS

| | | |
|---|---|---|
| WO | WO 2004/007312 A1 | 1/2004 |
| WO | WO 2005/051792 A1 | 6/2005 |
| WO | WO 2006/003453 A1 | 1/2006 |

* cited by examiner

CONTAINER CLOSURE

FIELD OF THE INVENTION

The present relates to the field of container closures. In one non-limiting aspect, the invention relates to the field of container closures for pressurized products, such as carbonated beverages. Additionally or alternatively, in a non-limiting aspect, the invention relates to the field of wide-mouth container closures.

Conventionally, carbonated beverages such as lemonade and beer are contained in bottles which have a screw threaded closure or a crimped metal closure. Generally, the closures are only of small diameter (typically less than 42 mm). This is because the amount of force exerted on the closure by the pressurized contents will depend on the area of the closure. It is theoretically possible for a larger size of screw-threaded closure to be used, but this would have to be tightened so firmly on the bottle that it would be extremely difficult for a person to unscrew it by hand. Accordingly, there has to be compromise between the size of the closure, the force that the closure can withstand, and the ability of a person to remove the closure by hand.

Even screw-threaded closures for non-pressurized containers may be screwed on so tightly that they can be difficult to remove. For example, screw-on closures of jars for jam or other preserves are often difficult to unscrew by hand.

The above problems are exacerbated in the case of carbonated beverages.

Generally, for carbonated beverages, the internal pressure can reach pressures of 100 psi (6.9 bar). Such high pressures may, for example, be reached during hot pasteurization of the bottle after filling. During storage at room temperature, the internal pressure is likely to be less than about 40 psi (2.8 bar), and a closure might be rated to withstand sustained pressure of at least 60 psi (4.1 bar). Nevertheless, the closure may have to be able to withstand much higher pressures.

Reference may be made to WO-A-00/69741 which describes a press-fit container closure including a plurality of depending segmented lugs with snap-fit projections for engaging behind the rim of a container mouth. An integral band embraces the lugs to lock the closure securely on the container mouth. To remove the closure, the band is lifted away (pivoted upwards). The lugs are then free to flex outwardly, allowing the closure to be lifted off the container mouth. The band may be secured to the lugs by frangible connections to provide a tamper evident feature. One or more predetermined lugs may be designed to be released prior to other lugs during opening, to vent internal pressure from within the container while the remaining lugs hold the closure securely and prevent the closure from blowing off the container mouth.

Depending on the individual design implementation, the functionality of the above closure design may in some cases be influenced by (i) the close interrelation between sealing and fastening functionality, and (ii) the relatively abrupt release of the bracing effect around the closure circumference when the band is lifted upwardly. Consequently, some closure designs may be difficult to optimize to suit different container applications.

It might be desirable to address at least some of the aforementioned issues and/or improve on existing designs.

SUMMARY OF THE DISCLOSURE

The following summary is intended to provide a non-limiting explanation of some of the ideas described in the current disclosure.

Some aspects of the disclosure are defined in the appended claims.

Additionally or alternatively, in one aspect of the disclosure, a closure for a container may comprise any of (optionally at least two of, optionally all three of): a cover portion; a fastener portion; and a bracing portion. The closure may optionally include one or any combination of two or more (or all) of the following features, which are all optional:

(a) The cover portion may be configured for covering at least a portion of a container mouth and/or for controlling a vent path in or through the closure. The cover portion may optionally embody or carry a seal for sealingly engaging the container, for example, at or around the mouth.

(b) The fastener portion may be configured for engaging a container for fastening the closure to the container, for example, at or around the container mouth.

(c) The bracing portion may extend generally in a circumferential direction of or around an axis of the closure, and may overlap at least partly at least one, and optionally both, of the cover portion and the fastener portion. Optionally, the bracing portion may overlap the respective other portion in an axial direction by about at least 3 mm, optionally at least 4 mm, optionally at least 5 mm, optionally at least 6 mm, optionally at least 7 mm, optionally at least 8 mm, optionally at least 9 mm, optionally at least 10 mm, optionally at least 11 mm, optionally at least 12 mm, optionally at least 13 mm, optionally at least 14 mm, optionally at least 15 mm. The degree of overlap may be varied to suit the support forces that the closure should be designed to bear in use.

(d) The bracing portion may bridge a discontinuity in the fastener portion, and/or in the cover portion, and/or between at least a portion of the fastener portion and at least a portion of the cover portion.

The term "discontinuity" may be used herein to refer to a discontinuity of a type that substantially reduces the ability of respective portion to bear stress or support forces at or across the discontinuity. It may optionally be referred to as a "strength discontinuity" or "non-load-supporting".

Examples of discontinuities may optionally include one or more of: a split; a gap; a region of weakness; an extensible region; an expandable region; a distensible region; a frangible region.

The discontinuity may be such that, without the bridging by another portion, two regions on opposite sides of the discontinuity may flex or displace apart under the effect of support forces across the discontinuity.

(e) The bracing portion may support, e.g. functionally, at least a portion of the cover portion and/or at least a portion of the fastener portion, and/or may anchor the cover portion to the fastener portion. For example, the bracing portion may bear a support force as a shear stress at an interface between the bracing portion and at least one of the cover portion and the fastener portion. In some embodiments, the connection at the interface may be such as to block, in both an axial direction and a circumferential direction, relative movement between the bracing portion and the cover portion and/or between the bracing portion and the fastener portion. This is contrary to, for example, a screw-threaded engagement or any other engagement involving or permitting axial, circumferential and/or helical relative movement. Optionally (e.g. as below), the interface may be separable in a radial direction, for example, upon peeling of the bracing portion circumferentially.

(f) The bracing portion may be manually peelable progressively (e.g. circumferentially) out of engagement with at least one of the cover portion and the fastener portion.

(g) Optionally, such peeling as above may (i) release progressively the shear stress at the or an interface with the bracing portion, and/or (ii) release progressively the force supported at the or an interface with the bracing portion, and/or (iii) reduce progressively the region of the closure around which the support force is borne by the bracing portion, and/or (iv) reduce the size of the interface with the bracing portion over which the support force is borne as shear stress, and/or (v) provide a circumferentially progressive release and/or relaxing effect for the cover portion and/or for the fastener portion.

(h) When the bracing portion is in a partly peeled state, shear stress may be released around a second region of the closure, whereas the shear stress may still be applied at an interface with the bracing portion around a first region of the closure. The second region may correspond to a region from which the bracing portion has been peeled. The first region may correspond to a region at which the bracing portion has not been peeled.

(i) Additionally or alternatively, when the bracing portion is in a partly peeled state, the cover portion may be partly released sufficiently to enable venting of pressure from an interior to an exterior of the closure.

(j) Additionally or alternatively, the cover portion may be configured to be displaceable relative to the fastener portion (at least when movement is not blocked by the bracing portion), for (i) opening a vent path and/or dispensing path in or through the closure, and/or (ii) for relaxing a seal against the container, for example, at or around the mouth.

(k) Additionally or alternatively, the bracing portion may be configured to bear a component (e.g. an axial component) of force between the cover portion and the fastener portion as shear stress at an interface between the bracing portion and at least one of the cover portion and the fastener portion, thereby to anchor the cover portion in a closed state (e.g. a non-venting state and/or a sealing state) with respect to the fastener portion.

(l) Additionally or alternatively, when the bracing portion is fully peeled, the cover portion may be openable with respect to the fastener portion to define a venting and/or dispensing path through the closure. For example, the cover portion may hinge open with respect to the fastener portion, or the cover portion may be disengageable from the fastener portion, or the fastener portion may be loosely coupled to the fastener portion (for example, by a captive tether).

(m) Additionally or alternatively, the bracing portion may be configured to brace the fastener portion circumferentially around at least a first region (or braced region) of the circumferential periphery of the retaining portion.

(n) Additionally or alternatively, the bracing portion may be configured to support the fastener portion so as to bear, at least partly, circumferential stress in at least a first region (or circumferentially reinforced region) of the fastener portion as shear stress at an interface between the fastener portion and the bracing portion.

(o) The aforementioned first region may optionally be at least 50% of the circumferential periphery (at least when the bracing portion is in a fully-assembled condition prior to removal or partial removal). Optionally the first region may be at least 60% of the circumferential periphery, optionally at least 70%, optionally at least 75%, optionally at least 80%, optionally at least 85%, optionally at least 90%. Additionally or alternatively, the first region may be less than 100% of the periphery, optionally less than 95% of the periphery, optionally less than 90% of the periphery.

(p) In some embodiments, a region of the fastener portion (third region) may be positioned circumferentially outside the first region, such that the third region is not directly braced or reinforced by the bracing portion at that point. The wall thickness of the fastener portion may be greater in at least part of the third region than in at least a part of (and optionally at least the majority of) the first region.

(q) When the bracing portion is fully peeled, the fastener portion may be disengageable from the container, to enable the closure to be fully removed from the container. For example, the fastener portion may comprise one or more splits or weaknesses that, when the fastener portion is no longer braced and/or reinforced by the bracing portion, enables the fastener portion to expand or release from fastening engagement with the container.

(r) Additionally or alternatively, the bracing portion may have the form (at least functionally) of an at least partial ring. In some embodiments the bracing portion has the form (at least functionally) of a split-ring or partial-ring (e.g. a band or collar of split-ring and/or partial-ring form). As used herein, the term "split-ring" and/or "partial-ring" is used to refer to an at least partial-loop shape (e.g. a "C" shape, or even a near-closed-loop shape) but with a discontinuity such that the "ring" has strength or support properties of a discontinuous ring. With such a bracing portion, the stress in the bracing portion is substantially non-annular (or may also be referred to as non-hoop). This is in contrast to a closed loop ring in which stress in the closed loop may be distributed as closed-loop hoop stress or annular stress. Providing a split-ring or partial-ring form of the bracing portion facilitates its peelability, and/or facilitates plastics moulding of a peelable portion.

(s) The split-ring or partial-ring form may have ends that are coupled to each other (e.g. substantially non-functionally and/or non-stress bearingly) by means of an expandable and/or frangible region. Alternatively, the split-ring or partial-ring form of bracing portion 22 may have end portions that are not directly coupled to each other (e.g. the bracing portion may have a "C" shape). The end portions may be separated by an angle of at least 10 degrees, optionally about or at least 30 degrees, optionally about or at least 60 degrees, optionally about or at least 90 degrees, optionally about or at least 120 degrees.

(t) Additionally or alternatively, the bracing portion may be provided as a continuous loop configuration, or as a split-ring or partial-ring form having ends that are functionally coupled together (for example, by an overlapping shear-stress coupling engagement).

(u) Whatever the form of the bracing portion, in some embodiments, the bracing portion may optionally be stabilized in the circumferential direction by the cover portion, the circumferential stress being at least partly transmitted to the cover portion as shear stress at an interface between the bracing portion and the cover portion. Such an arrangement may, for example, enable the bracing portion to be made relatively thin, because the bracing portion need not have to bear support circumferential stress entirely independently.

(v) Additionally or alternatively to any of the above, the interface between the bracing portion and the cover portion and/or between the bracing portion and the fastener portion, may comprise interfitting and/or mating surface profiles capable of bearing shear stress at the interface. For example, the surface profiles may comprise interpenetrating male features (e.g. any of ribs, teeth, bosses and/or barbs), or an arrangement of male features (e.g. any of ribs, teeth, bosses and/or barbs) and female features (e.g. any of apertures, recesses and/or sockets). In some embodiments comprising both male and female features, one surface profile may generally comprise the male features and the other may generally comprise the female features. Alternatively, in some other embodiments each surface profile may comprise a mix of both male and female features. In any case, the male and female features may be of any desired cross-section shape, for example, rectangular, or square, or round, or oval, or any other shape. The cross-section shape may also vary around the circumference, and/or multiple cross-section shapes may be used.

(w) In some embodiments, the surface profiles may interfit and/or mate in such a manner as to block, in both an axial direction and a circumferential direction, relative movement between the bracing portion and the cover portion and/or between the bracing portion and the fastener portion. This is contrary to, for example, a screw-threaded engagement or any other engagement involving or permitting axial, circumferential and/or helical relative movement. The surface profiles may be separable in a radial direction, for example, upon peeling of the bracing portion.

(x) In some embodiments, the surface profiles may comprise respective networks of plural male and/or female features extending or distributed both circumferentially and axially (e.g. in a two dimensional array). For example, each network may comprise a plurality of male and/or female features provided at different positions in the circumferential direction, and a plurality of male and/or female features provided at different positions in the axial direction.

(y) In some embodiments, at least some of the features of the surface profiles may be aligned generally obliquely to a radial direction or radial plane. In some embodiments, the magnitude and/or direction of the alignment angle with respect to a radial direction or plane may vary amongst at least some of the features. In some embodiments, the variation of the magnitude and/or direction of the alignment angle may repeat circumferentially and/or axially amongst groups of the features around the circumference of the closure.

(z) In some embodiments, at least some of the features of the surface profiles may have different radial extents from one another. In some embodiments, at least one of the features may have a first radial extent, and at least one other of the features may have a second radial extent different from the first. The radial extent may optionally be referred to as a radial "height" for a male feature, or may optionally be referred to as a radial "depth" for a female feature. In some embodiments, at least one (and optionally at least a first plurality) of the features may have the first radial extent, and at least one other (and optionally at least a second plurality) of the features may have the second radial extent.

(za) In some embodiments, the first plurality of features may include apertures having a radial extent (e.g. radial depth) extending radially substantially entirely through a wall of a respective portion of the closure (for example, any of the cover portion, the fastener portion, and/or the bracing portion), and the second plurality of features may include recesses having a radial extent (e.g. radial depth) that does not extend entirely through the wall of the respective portion.

(zb) Additionally, or alternatively, to any of the above, the interface between the bracing portion and the cover portion and/or between the bracing portion and the fastener portion, may be a junction between layers of a peelable laminate. The layers may be coupled together peelably by any of adhesive, plastics bonding, melt bonding, fusion and/or welding.

Additionally or alternatively to the above, in another aspect of the disclosure, a closure for a container may comprise a first portion (optionally, a first layer or first body, and/or optionally including one or both of a cover portion and a fastener portion), and a second portion (optionally, a second layer or second body, respectively, and/or optionally including a bracing portion). At least one of the portions may include a discontinuity (optionally, a non-load-supporting discontinuity, e.g. a split, a gap or region of weakness). The other portion may overlap at least partly the first portion so as to bridge the discontinuity, and to reinforce the discontinuity by bearing support force across the discontinuity as shear stress at at least one interface between the first portion and the second portion.

The closure may optionally include any of the features of the first aspect described above.

In some embodiments the, or at least a part of the, discontinuity may extend in a circumferential direction at least partway around the closure. Additionally or alternatively the, or at least a part of the, discontinuity (or a further discontinuity) may extend in a generally axial direction. Additionally or alternatively, the discontinuity (or a further discontinuity) may extend at least partly in a direction with both an axial component and a circumferential component.

In some embodiments, the discontinuity may be generally linear, or curved, or curvilinear.

In some embodiments, both of the first and second portions include respective discontinuities (e.g. non-load-supporting discontinuities, and/or discontinuities which may be different from each other), and each of the first and second portions overlaps at least partly the other so as to bridge the discontinuity in the other, and to reinforce the discontinuity in the other by bearing support force across that discontinuity as shear stress at at least one interface between the first and second portions. For example, the first portion may reinforce one or more discontinuities in the second portion, and the second portion may reinforce one or more discontinuities in the first portion.

In some embodiments, the first portion and the second portion may nest, at least partly, one inside another. For example, the first portion may nest radially within the second portion. Additionally or alternatively, an exterior of the first portion may be substantially contained with an interior of the second portion.

In some embodiments, at least one of the first and second portions is peelably separable from the other. Separating the first and second portions in a first region may remove or reduce the reinforcement of the first and second portions across one or more of the discontinuities, by removing or reducing the interface at which support force is borne as shear stress. In a second region where an interface between the first and second portions is intact, support may be borne as shear stress to provide reinforcement at this region.

Optionally, in some embodiments, progressive peeling of at least one of the first and second portions from the other may (i) permit venting of pressure, and/or (ii) permit opening of the closure. For example, in some embodiments, progressive peeling of at least one of the first and second portions from the other may permit venting of pressure, and further progressive peeling may permit opening of the closure.

In some embodiments, the first portion may comprise a fastener portion and a cover portion. A first discontinuity (e.g. extending generally in a circumferential direction at least partway around the closure) may be defined between the fastener portion and the cover portion. The first discontinuity may permit the cover portion to lift at least slightly with respect to the fastener portion when the reinforcement provided by the second portion is at least partly removed, to permit venting of pressure without interfering with the fastener portion. Optionally, a second discontinuity (e.g.

extending generally in an axial direction) may be defined in the fastener portion. The second discontinuity may permit the fastener portion to be expanded to disengage from the container when the reinforcement provided by the second portion is removed. Optionally, when at least a region of the second portion is removed by progressive peeling, the reinforcement provided by the second portion is removed (or at least starts to be removed) from the first discontinuity before the second discontinuity.

Additionally or alternatively, in some embodiments, the second portion may have the form (at least functionally) of a split-ring or partial-ring, band or collar, such that the stress in the second portion is substantially non-annular (or may also be referred to as non-hoop). This is in contrast to a closed loop ring form, in which stress in the closed loop may be distributed as closed-loop hoop stress or annular stress. Providing a split-ring or partial-ring form of the second portion facilitates its peelability, and/or facilitates plastics moulding of a peelable portion.

In some embodiments, the discontinuity in the second portion may have an "S" shape, or may extend at least partly in a diagonal direction having components in both the axial and circumferential directions.

Additionally or alternatively to any of the above, in another aspect of the disclosure, a moulded plastics closure for a container may comprise a first portion (optionally, a first layer or first body, and/or optionally including one or both of a cover portion and a fastener portion), and a second portion (optionally, a second layer or second body, respectively, and/or optionally including a bracing portion). The second portion may reinforce at least a region of the first portion. At least a portion of the second portion may be circumferentially peelable radially outwardly from the first portion, to (i) permit venting of pressure, and/or (ii) permit opening of the closure.

For the avoidance of doubt, the above aspects disclose independently both (i) a closure in isolation, and (ii) in combination with a container (or container mouth).

In some embodiments of any of these aspects, the closure may be configured to fit a container mouth having a diameter of at least 60 mm. Additionally or alternatively, in some embodiments, the closure may be configured to withstand pressurized container contents, such as a carbonated beverage.

Additionally or alternatively to any of the above, in another aspect of the disclosure, a moulded plastics closure for a container may comprise:

a cover portion for covering at least a portion of the container mouth;

a fastener portion for engaging the container for fastening the closure to the container; and a bracing portion extending generally in a circumferential direction of or around an axis of the closure, the bracing portion overlapping at least partly at least one of the cover portion and the fastener portion, an interface between the overlapping portions comprising male features on at least one of the portions interfitting with female features of another overlapping portion.

In some embodiments, at least the bracing portion comprises male features. Additionally or alternatively, at least one of the cover portion and the fastener portion comprises female features.

For the avoidance of doubt, the above aspects disclose independently both (i) a closure in isolation, and (ii) in combination with a container (or container mouth).

In some embodiments of any of these aspects, the closure may be configured to fit a container mouth having a diameter of at least 60 mm. Additionally or alternatively, in some embodiments, the closure may be configured to withstand pressurized container contents, such as a carbonated beverage.

Additionally or alternatively to any of the above, in another aspect of the disclosure, a closure for a container may comprise a first portion and a second portion, at least one of the portions comprising a discontinuity (e.g. a non-load-supporting discontinuity), and the other of the portions overlapping at least partly the discontinuity so as to bridge the discontinuity, and provide reinforcement across the discontinuity, an interface between the overlapping portions comprising male features on at least one of the portions interfitting with female features of another overlapping portion.

For the avoidance of doubt, the above aspects disclose independently both (i) a closure in isolation, and (ii) in combination with a container (or container mouth).

In some embodiments of any of these aspects, the closure may be configured to fit a container mouth having a diameter of at least 60 mm. Additionally or alternatively, in some embodiments, the closure may be configured to withstand pressurized container contents, such as a carbonated beverage.

Additionally or alternatively to any of the above, in another aspect of the disclosure, a closure for a container may comprise a laminate comprising a first layer and a second layer, at least one of the layers comprising a discontinuity, and the other of the layers overlapping at least partly the discontinuity so as to bridge the discontinuity, and provide reinforcement across the discontinuity, and wherein at least one of the layers comprises a peelable bracing portion of the closure.

For the avoidance of doubt, the above aspects disclose independently both (i) a closure in isolation, and (ii) in combination with a container (or container mouth).

In some embodiments of any of these aspects, the closure may be configured to fit a container mouth having a diameter of at least 60 mm. Additionally or alternatively, in some embodiments, the closure may be configured to withstand pressurized container contents, such as a carbonated beverage.

A further aspect of the disclosure may relate to a method of production of a closure comprising first and second bodies. The method may comprise:

(a) moulding a first body of a closure, the first body including surface profile features for defining an interface able to bear shear stress; and (b) moulding a second body of the closure on the first body, by using the first body to partly define a mould surface for the second body, the second body being moulded to have complementary surface profile features mating with the first body at the interface;

wherein one of the bodies comprises a bracing portion configured to support one or more portions of the other body by bearing a support force as shear stress at the interface, and wherein the bracing portion is peelable from the interface.

The closure may optionally include any of the features described hereinbefore.

In some embodiments, the closure may be configured to fit a container mouth having a diameter of at least 60 mm. Additionally or alternatively, in some embodiments, the closure may be configured to withstand pressurized container contents, such as a carbonated beverage.

A further aspect of the disclosure may relate to a method of fitting a closure to a container mouth, the method comprising:

(a) providing a closure comprising a heat-shrink laminate, the laminate comprising a first and second layers at least partly overlapping each other such that a first of the layers braces a second of the layers by bearing support force as shear stress at an interface between the layers, and wherein at least one of the layers comprises a portion peelable from the other layer;

(b) placing the closure at the mouth of a container; and (c) heating the closure to cause the laminate to shrink into fastening engagement with the container.

The step of heating may, for example, comprise generating heat in the closure (for example, by application of electricity or inducement of heat), or subjecting the closure to heat by any other technique, such as laser heating or hot air heating or placing or passing the closure and/or container in or through an oven heated to a suitable temperature.

The closure may optionally include any of the features described hereinbefore.

In some embodiments, the closure may be configured to fit a container mouth having a diameter of at least 60 mm. Additionally or alternatively, in some embodiments, the closure may be configured to withstand pressurized container contents, such as a carbonated beverage.

Although certain features and ideas have been discussed above and/or in the appended claims, protection is claimed for any novel feature or idea disclosed herein and/or illustrated in the drawings, whether or not emphasis has been placed thereon.

DETAILED DESCRIPTION OF PREFERRED EMBODIMENTS

Figure 1:
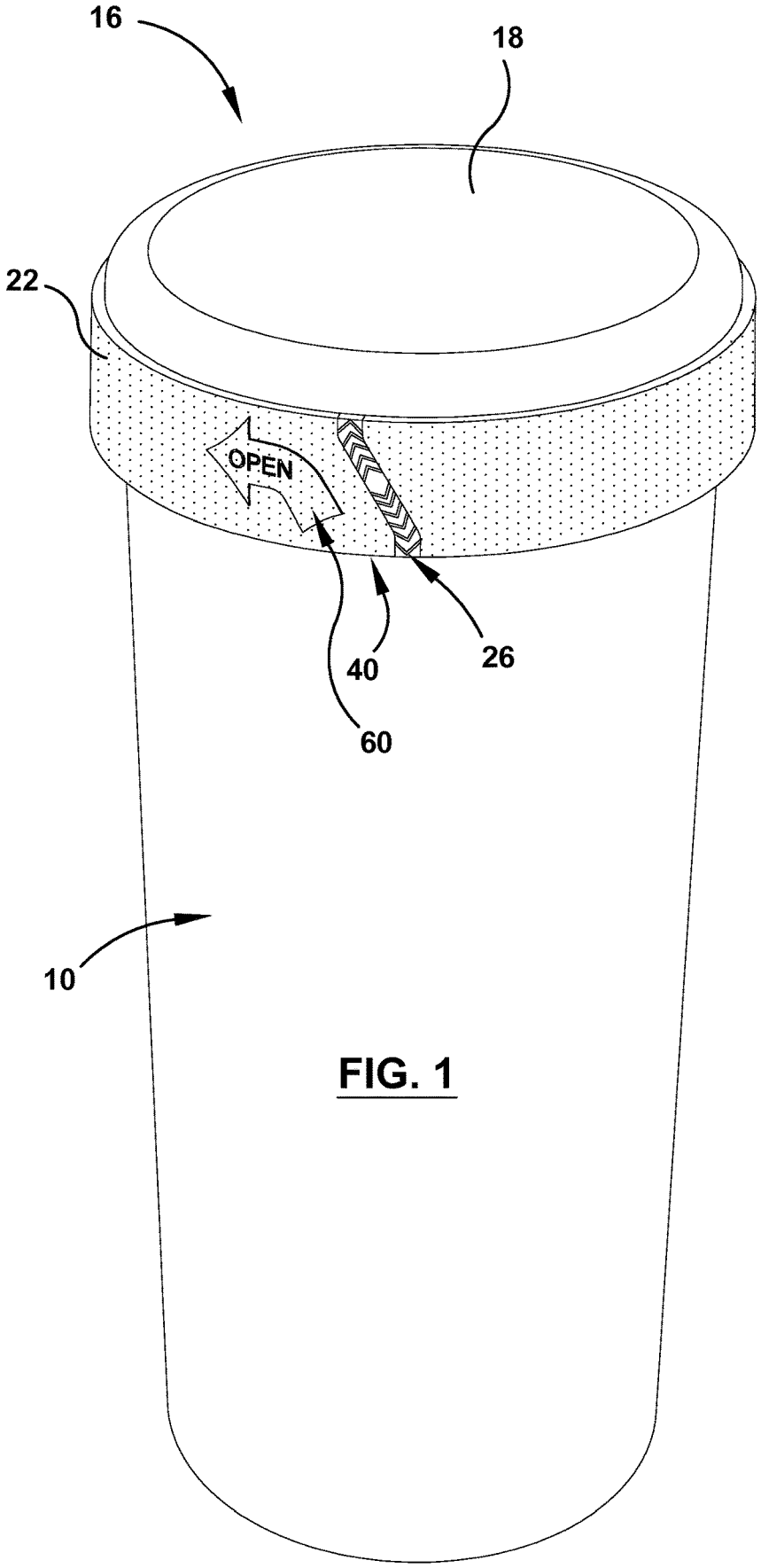
FIG. 1 is a schematic perspective view from above showing a container carrying a closure of a first embodiment in a closed and sealed condition.

Non-limiting embodiments of the disclosure are now described with reference to the aforementioned drawings, in which the same reference numerals are used to denote the same or equivalent features.

Referring to the drawings, a glass or plastics container 10 is illustrated for pressurized contents, such as a carbonated beverage. The present embodiment is intended to contain a beer, cider, or carbonated drink, and may be shaped in the form of a drinking glass. However, in other embodiments the container 10 may have other forms, for example, bottle shaped (wide or narrow mouthed). The container 10 may also be used for other pressurized contents, or for non-pressurized contents if desired (as described later).

The container 10 (in whatever form) may optionally have a mouth 12 in the form of a wide-mouth opening, which is typically at least 60 mm in diameter, optionally about or at least 65 mm, optionally about or at least 70 mm, optionally about or at least 75 mm. Optionally, the opening 12 may be generally between about 60 mm and 80 mm in diameter. In other embodiments (e.g. non-wide-mouth), the opening may be equal to or less than 60 mm in diameter.

In some embodiments, the mouth 12 is circumscribed by a fastening profile 14 for a closure 16. The fastening profile 14 may, for example, comprise or be any of: a recess (e.g. annular or bayonet); and/or an undercut lip; and/or at least a portion of a screw thread. In other embodiments, the mouth 12 may be absent from any discernable fastening profile.

The closure 16 may comprise one or more (optionally at least two, and optionally all three) of: a cover portion 18; a fastener portion 20; and/or a bracing portion 22.

The cover portion 18 may optionally be configured for covering at least a portion of the mouth 12. The cover portion 18 may optionally embody or carry a seal 24 for sealingly engaging the container 10, for example, at or around the mouth 12. The seal 24 may, for example, comprise a liner or other insert provided on the cover portion 18, or it may comprise an integrally moulded portion of the cover portion 18, such as (merely by way of example) an annular wiper, or a compressible ring, or a depending annular wall, or merely a suitable surface of the cover portion 18 itself.

The fastener portion 20 may be configured for fastening the closure 16 to the container 10, for example, around the mouth 12, and for example, to the fastening profile 14 if provided. The design of the fastener portion 20 may optionally depend on the configuration of the fastening profile 14 if provided. For example, the fastener portion 20 may comprise any of: one or more radially inwardly directed protrusions; an undercut lip or lug; a bayonet coupling part; a screw threaded part; a fastening band; fastening teeth.

The bracing portion 22 may extend generally in a circumferential direction of or around the closure 16, and may overlap at least partly at least one, and in the illustrated form at least partly both, of the cover portion 18 and the fastener portion 20.

The bracing portion 22 may bridge a discontinuity (e.g. a gap or a split) in the fastener portion 20, and/or in the cover portion 18, and/or between at least a portion of the fastener portion 20 and at least a portion of the cover portion 18. For example, the bracing portion 20 may bridge a split 30 (described later) in the fastener portion 20. Additionally or alternatively, the bracing portion 20 may bridge a gap 38 (described later) between portions of the cover portion 18 and the fastener portion 20.

The bracing portion 22 may support, e.g. functionally, at least a portion of the cover portion 18 and/or at least a portion of the fastener portion 20, and/or may anchor or lock the cover portion 18 to the fastener portion 20. For example, the bracing portion 22 may reinforce the fastener portion 20 to securely fasten the closure 16 to the container 10. Additionally or alternatively, the bracing portion 22 may anchor the cover portion 18 relative to the fastener portion 20, such that the cover portion 18 provides a seal able to withstand the internal pressure of the container contents.

In some embodiments, the bracing portion 22 may bear a support force as a shear stress at an interface between the bracing portion 22 and at least one of the cover portion 18 and the fastener portion 20. Optionally, the connection at the interface may be such as to block, in both an axial direction and a circumferential direction, relative movement between the bracing portion 22 and the cover portion 18 and/or between the bracing portion 22 and the fastener portion 20. This is contrary to, for example, a screw-threaded engagement or any other engagement involving or permitting axial, circumferential and/or helical relative movement. Optionally (e.g. as below), the interface may be separable in a radial direction, for example, upon peeling of the bracing portion circumferentially.

In some embodiments, the bracing portion 22 may overlap the cover portion 18 in an axial direction by at least 3 mm, optionally at least 4 mm, optionally at least 5 mm, optionally at least 6 mm, optionally at least 7 mm, optionally at least 8 mm, optionally at least 9 mm, optionally at least 10 mm, optionally at least 11 mm, optionally at least 12 mm, optionally at least 13 mm, optionally at least 14 mm, optionally at least 15 mm. Additionally or alternatively, the bracing portion 22 may overlap the fastener portion 20 in an axial direction by at least 3 mm, optionally at least 4 mm, optionally at least 5 mm, optionally at least 6 mm, optionally at least 7 mm, optionally at least 8 mm, optionally at least 9 mm, optionally at least 10 mm, optionally at least 11 mm, optionally at least 12 mm, optionally at least 13 mm, optionally at least 14 mm, optionally at least 15 mm. The degree of either or both overlaps may be varied to suit the support forces that the closure should be designed to bear in use.

The bracing portion 22 may be manually peelable progressively (e.g. circumferentially) out of engagement with at least one of the cover portion 18 and the fastener portion 20. Optionally, such peeling may (i) release progressively the shear stress at the or an interface with the bracing portion, and/or (ii) release progressively the force supported at the or an interface with the bracing portion, and/or (iii) reduce progressively the region of the closure around which the support force is borne by the bracing portion, and/or (iv) reduce the size of the interface with the bracing portion over which the support force is borne as shear stress, and/or (v) provide a circumferentially progressive release and/or relaxing effect for the cover portion 18 and/or for the fastener portion 20.

Bearing a support force by use of shear stress at the interface can enable the interface to bear a relatively high support force in the shear direction of the interface, while enabling the interface to be separated relatively easily when desired, by applying only a modest peel force. The interface can withstand (in the shear direction) the relatively high forces for maintaining even a wide-mouth closure 16 securely fastened and sealed against internal pressure, while enabling the interface to be separated by peeling the bracing portion 22 manually in a direction away from the interface.

Moreover, in some embodiments, the shear stress may be distributed at the interface such that peeling the bracing portion 22 in one local region ("second region") around the periphery of the closure 16, does not disrupt the bracing portion 22 bearing a support force in another local region ("first region") around the periphery. The support force may be borne locally by the bracing portion 22, as local circumferential stress in the portion of the bracing portion 22 in the first region. Such an arrangement can permit progressive release of the support or bracing function of the bracing portion 22 as the bracing portion is peeled progressively.

When the bracing portion 22 is in a partly peeled state, shear stress may be released around a second region of the closure 16, whereas the shear stress may still be borne at an interface with the bracing portion 22 around a first region of the closure 16. The second region may correspond to a region from which the bracing portion 22 has been peeled. The first region may correspond to a region at which the bracing portion 22 has not been peeled.

Additionally or alternatively, in some embodiments, the fastener portion 20 and/or the cover portion 18 and/or a connection region 36 therebetween (described later) may bridge a discontinuity (e.g. a non-load-supporting discontinuity and/or a gap and/or an expandable and/or frangible region 26 described below) in the bracing portion 22. The bracing portion 22 may therefore include a discontinuity that enables the bracing portion 22 to be split for peeling. Yet the discontinuity may be reinforced prior to opening of the closure, by being bridged by a respective portion of the fastener portion 20 and/or the cover portion 18 and/or a connection region 36 therebetween.

The discontinuity in the bracing portion may be relatively small (e.g. extending circumferentially less than about 10 mm, and/or extending over an angle of less than about 10 degrees about the central axis), or it may be relatively large (e.g. extending circumferentially at least 10 mm, and/or extending over an angle of at least 10 degrees about the central axis; for example, about or at least 30 degrees, or about or at least 60 degrees, or about or at least 90 degrees, or about or at least 120 degrees).

Additionally or alternatively, in some embodiments the bracing portion 22 has the form (at least functionally) of a split-ring or partial-ring (e.g. a band or collar of split-ring band and/or partial-ring form). The term "split-ring" and/or "partial-ring" may be used here to refer to an at least partial-loop shape (e.g. a "C" shape, or even a near-closed-loop shape) but with a discontinuity such that the "ring" has strength or support properties of a discontinuous ring. With such a bracing portion 22, stress in the ring is substantially non-annular (or may also be referred to as non-hoop). This is in contrast to a closed loop ring in which stress in the closed loop would be distributed as closed-loop hoop stress or annular stress. Providing a split ring or partial-ring form of the bracing portion 22 facilitates its peelability, and/or facilitates plastics moulding of a peelable portion.

The split-ring for partial-ring form of the bracing portion 22 may in some embodiments have end regions that are coupled to each other (e.g. substantially non-functionally and/or non-stress bearingly) by means of an expandable and/or frangible region 26. In use, a user may break the frangible region 26 to begin peeling of the bracing portion 22 for opening the closure 16. Additionally or alternatively, the bracing portion may be provided as a continuous loop configuration, or as a split-ring or partial-ring having ends that are functionally coupled together (for example, by an overlapping shear-stress coupling engagement), and configured to be peelable, e.g. circumferentially.

The frangible region 26 may optionally be defined by at least one, and optionally plural, frangible connections. For example, plural frangible connections may extend along the frangible region 26. The frangible region 26 may be broken by, for example, progressively separating the frangible connections along the frangible region 26, in a similar manner to peeling.

Figure 23:
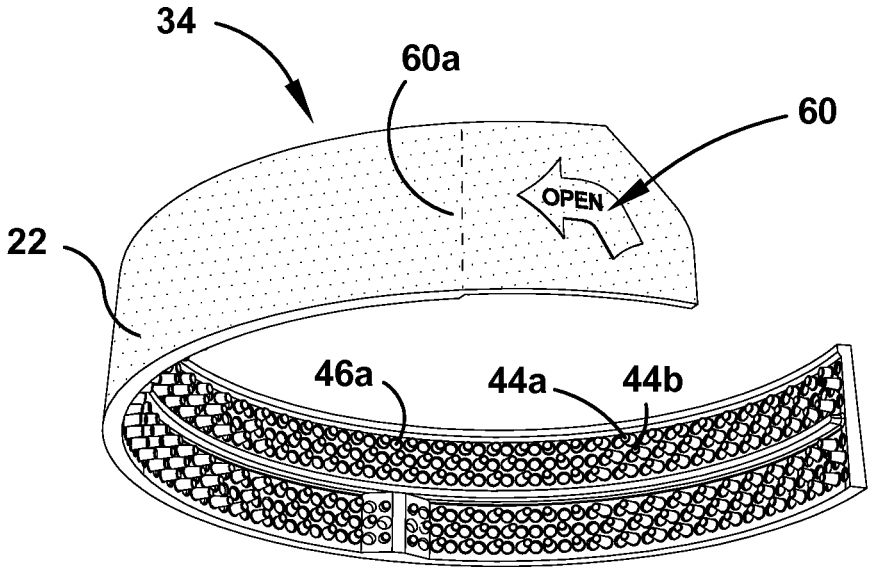
FIG. 23 is a schematic view similar to FIG. 3, but showing a second body of the seventh embodiment in isolation.

In other embodiments, the split-ring or partial-ring form of the bracing portion 22 may have end portions that are not directly coupled to each other. Instead, the end portions may be spaced apart or separated by the discontinuity. As mentioned above, the end portions may be spaced apart or separated by an angle of less than 10 degrees about the axis of the closure, or at least 10 degrees, or about or at least 30 degrees, or about at least 60 degrees, or about at least 90 degrees, or about or at least 120 degrees. FIG. 23 illustrates an example in which the gap in the split-ring or partial-ring is about 120 degrees and/or about a third of a complete circle.

Whatever the form of the bracing portion 22, in some embodiments, the bracing portion 22 may optionally be stabilized in the circumferential direction by the cover portion 18, the circumferential stress being at least partly transmitted to the cover portion 18 as shear stress at an interface between the bracing portion 22 and the cover portion 18. Such stabilization may be especially advantageous for a bracing portion 22 having a split-ring functional form.

Additionally or alternatively, the discontinuity in the bracing portion 22 may be bridged and/or reinforced by a portion of (i) the cover portion 18, and/or (ii) the fastener portion, and/or (iii) a connection region 36 therebetween.

Various different interface forms, that are peelable and able to bear shear stress, may be used for the interface between the bracing portion 22 and the cover portion 18 and/or between the bracing portion 22 and the fastener portion 20. In some embodiments, the interface may be provided by interfitting and/or mating surface profiles (see FIGS. 2-15, described in more detail later below), for example, providing relative grip or traction in a shear direction. Additionally or alternatively, the interface may be provided by a junction between layers of a peelable laminate (see FIGS. 16-19, described in more detail later below). Unless specifically limited to a particular interface form, the present description is applicable to any kind of interface form, and is to be read and interpreted universally.

In some embodiments, the closure 16 is configured to resist, at least to some degree, free peeling of the bracing portion 22 out of engagement with the cover portion 18 and/or out of engagement with the fastener portion 20. For example, a positive peel force may be needed to peelably separate the bracing portion 22 at the interface, although the peel force may relatively modest to facilitate peeling manually. Such a peel force, or resistance to peeling, may be provided by the shape and/or orientation of mechanically interfitting parts (e.g. having at least some edges or surfaces that catch or bind one against another in the direction of peel), and/or by resistance of a chemical bond (e.g. adhesive or fusion or plastics bonding), and/or by tight-fitting between the interfitting parts, for example, created by shrinkage of plastics defining female features to at least partly grip the male features around which the female features are moulded (described later).

In some embodiments, the direction of peel may be generally orthogonal to a shear direction at the interface.

In some embodiments, the bracing portion 22 may be configured to support the fastener portion 20 so as to bear, at least partly, circumferential stress in at least a first region (or circumferentially reinforced region) of the fastener portion 20 as shear stress at an interface between the fastener portion 20 and the bracing portion 22. The aforementioned first region may be at least 50% of the circumferential periphery (at least when the bracing portion is in a fully-assembled condition prior to removal or partial removal). Optionally the first region may be at least 60% of the circumferential periphery, optionally at least 70%, optionally at least 75%, optionally at least 80%, optionally at least 85%, optionally at least 90%. Additionally or alternatively, the first region may be less than 100% of the periphery, optionally less than 95% of the periphery, optionally less than 90% of the periphery. For example, if the bracing portion 22 includes a discontinuity of magnitude between 90 degrees and 120 degrees, then the first region may extend up to angle in a range of 270 degrees and 240 degrees, respectively.

In some embodiments, a region 28 of the fastener portion (third region) may be positioned circumferentially outside the first region, such that the third region 28 is not directly braced or reinforced to the same degree by the bracing portion 22 at that point. The wall thickness of the fastener portion 22 may be greater in at least part of the third region 28 than in at least a part (and optionally the majority) of the first region. The third region 28 may correspond to a discontinuity between end portions of the bracing portion 22 (e.g. if a split-ring or partial-ring form) and/or a functional split in the bracing portion 22 and/or to the frangible region 26 and/or to the position of a connection region 36 (described below) between the fastener portion 20 and the cover portion 18.

In some embodiments, the closure 16 is opened by manual peeling of the bracing portion 22. As the peeling progresses, the support and/or reinforcement and/or anchoring provided the bracing portion 22 may be progressively reduced around the periphery of the closure 16. Additionally or alternatively, in some embodiments, a local support and/or reinforcement and/or anchoring provided by the bracing portion 22 may be reduced or removed where the bracing portion 22 is peeled away.

Progressive removal of support for the cover portion 18 may enable venting of internal pressure, without risking substantial weakening the fastener strength provided by the fastener portion 20. Under the internal pressure of the container contents, the cover portion 18 may deform and/or displace locally where it is no longer supported and/or anchored relative to the fastener portion 20. Such deformation and/or displacement may result in the cover portion 18 lifting or unseating from sealing engagement, thereby allowing the internal pressure to vent or escape past the seal 24. One or more splits or weaknesses (e.g. 31 in FIG. 22) may if desired be provided in the depending side-wall portion of the cover portion 18 to enable the cover portion 18 to flex slightly to permit such lifting or unseating locally to vent internal pressure.

After venting has been initiated, and with further peeling of the bracing portion 22, the closure may be "opened". Opening may occur by removal of the closure 16 from the container mouth 12, and/or removal of at least the cover portion 18, and/or opening of the cover portion 18 relative to the fastener portion 20.

For example, the reinforcement of the fastener portion 20 may be released progressively and/or locally. The fastener portion 20 may be sufficiently relaxed or released to enable the fastener portion 20, and therefore the closure in general, to be removed from the container mouth 12. For example, the fastener portion 20 may comprise one or more splits or weaknesses 30 that, when the fastener portion 20 is no longer braced and/or reinforced by the bracing portion 22, enables the fastener portion 20 to expand or release from fastening engagement with the container 10.

Additionally or alternatively, after the cover portion 18 has been allowed to deform or displace to effect venting of internal pressure, further peeling away of the bracing portion 22 around the periphery of the closure 16 may permit the cover portion 18 to be opened relative to the fastener portion 20 to provide a dispensing aperture through the closure 16, whether or not the fastener portion 20 is separated from the container 10.

Referring in more detail to FIGS. 1 to 15, 22 and 23, further construction details of a first embodiment are now described.

In some embodiments, at least two, and optionally all three, of the cover portion 18, the fastener portion 20, and the bracing portion 22 may be a continuous body. For example, at least the cover portion 18 and the fastener portion 20 may be a continuous first body 32.

Referring to FIGS. 2, 3, 22 and 23, in some embodiments, the closure 16 may comprise first and second bodies 32 and 34 in intimate contact, for example, as an integral unit. The first and second bodies 32 and 34 may, for example, be integrally formed by multi-shot plastics moulding, or by lamination, or by forming from a laminate. The first and second bodies 32 and 34 may be coupled as a unit by any one or more of: mechanical engagement, fusion, welding, adhesives, plastics bonding, melt bonding.

As mentioned above, the first body 32, e.g. an inner body, may comprise the cover portion 18 and the fastener portion 20. The second body 34, e.g. an outer body, may comprise the bracing portion 22. If desired, the two bodies 32 and 34 may have the same colour, or may be of different colours, for example, to provide a more easily visible tamper evident feature.

In some embodiments, the cover portion 18 may be coupled to the fastener portion 20, for example, by a connection region 36 (e.g. integral connection) of the first body 32. The connection region 36 may be substantially rigid, semi-rigid, or flexible. The connection 36 region may optionally define a hinge between, or a cantilever support of, the cover portion 18 and the fastener portion 20. This can facilitate moulding, while still permitting some deformation or displacement of the cover portion 18 when desired for venting and/or opening. In the first body 32 itself, the cover portion 18 and the fastener portion 20 may be separated axially by a gap 38 extending circumferentially, except at the connection region 36. The gap 38 is bridged in the axial direction by the bracing portion 22 when the first and second bodies 32 and 34 are in their united condition, to anchor the cover portion 18 to the fastener portion 22 as explained previously above.

Additionally or alternatively, in some embodiments, the fastener portion 20 of the first body 32 may comprise one or more splits 30. The split(s) 30 may be bridged by bracing portion 20 prior to peeling of the bracing portion 22, such that the fastener portion 20 acts as a closed loop ring for fastening the closure 16 to the container 10. Upon peeling the bracing portion 22 to unbridge the split(s) 30, the fastener portion 20 may be relaxed to permit removal from the container 10. In the illustrated form, a single split 30 is provided, but a greater number of splits or fastener segments may be used as desired.

Figure 17:
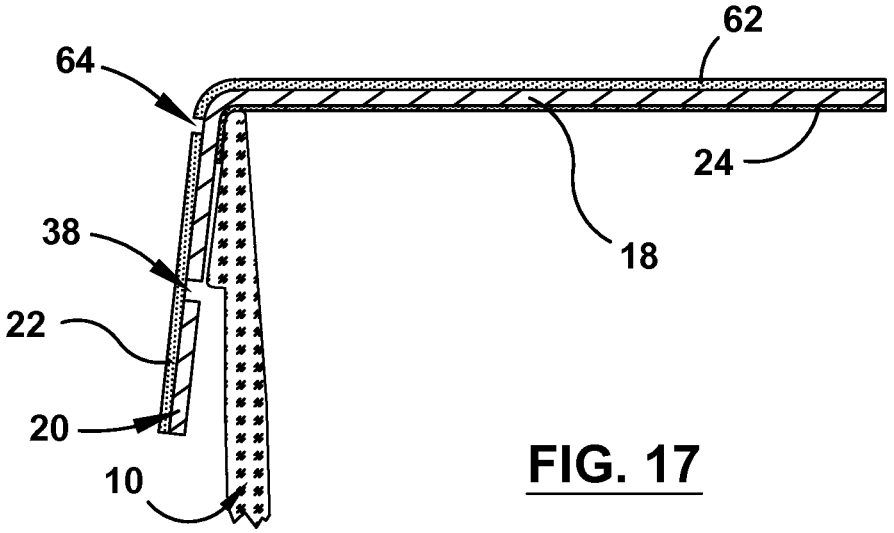
FIG. 17 is a schematic cross-section showing a third embodiment of closure being fitted to a container.
Figure 18:
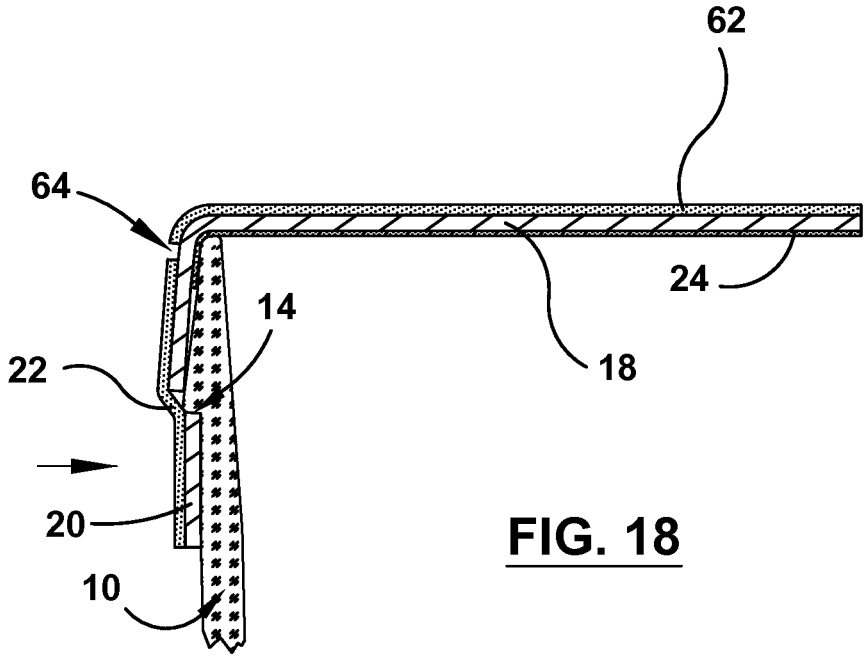
FIG. 18 is a schematic cross-section similar to FIG. 17, but showing the closure in a fully fitted condition.

The second body 34 may extend circumferentially of or around at least a portion of a depending side wall of the first body 32. In some embodiments, the second body may optionally extend around at least a majority of a circumference of the depending side wall. Additionally or alternatively, in some embodiments (e.g. as illustrated in FIGS. 1-16, 22 and 23), the second body 34 does not extend substantially over the top wall of the first body 32. The cover portion 18 of the first body 32 may then define the top wall of the closure 16. However, in other embodiments (e.g. as illustrated in FIGS. 17-18), the second body 34 may extend at least partly, and optionally entirely, over the top wall of the first body 32, for example, as an outer shell 62 of the closure 16.

Figure 2:
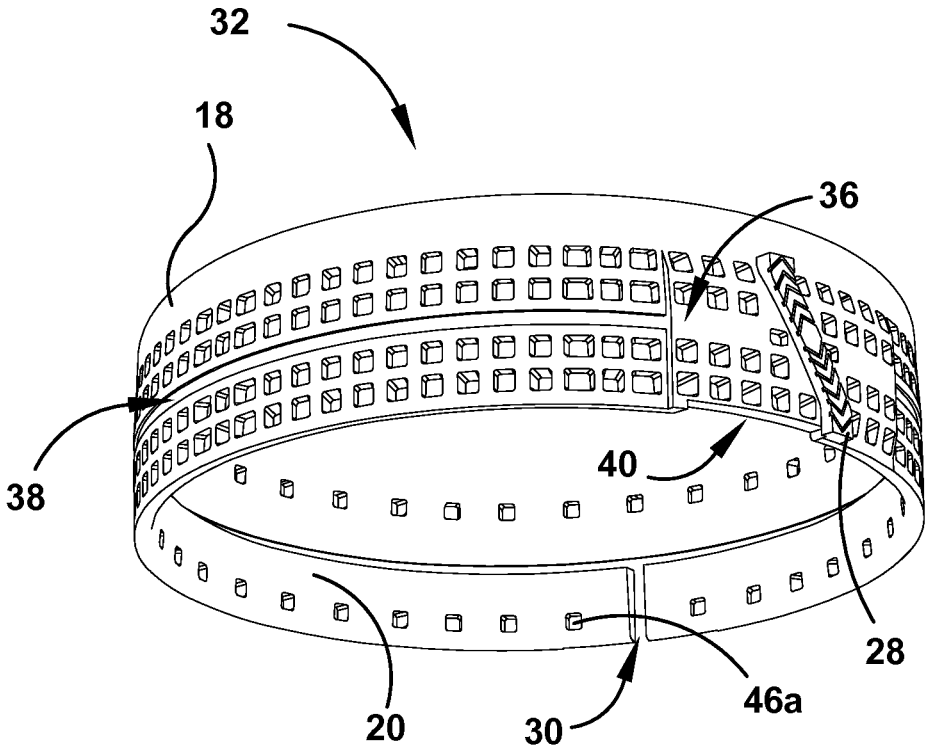
FIG. 2 is a schematic perspective view from below of a first body of the closure of FIG. 1 in isolation.
Figure 3:
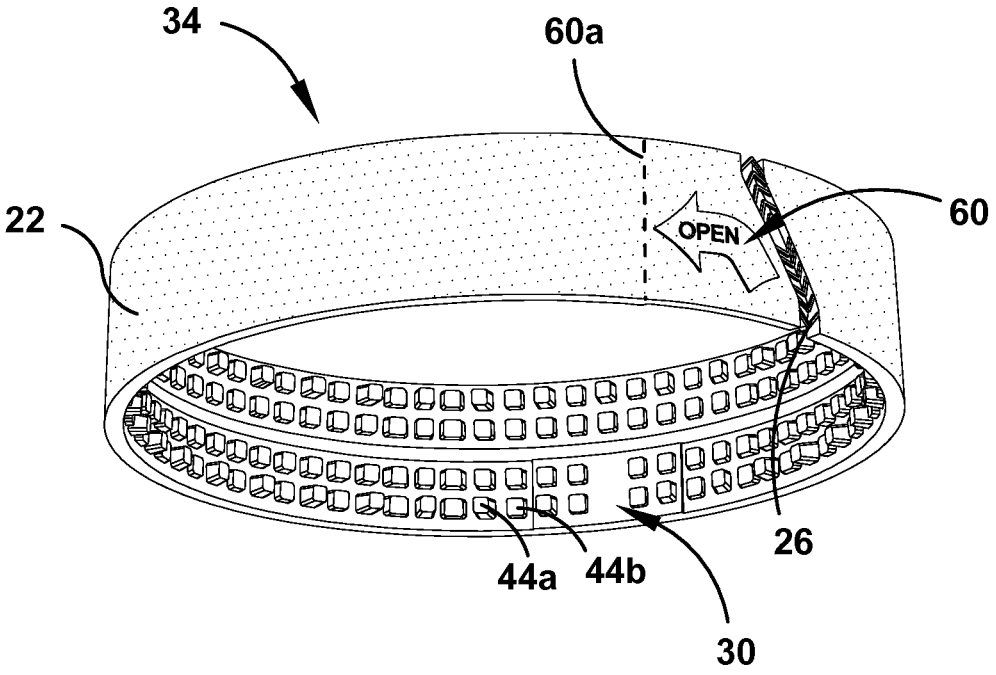
FIG. 3 is a schematic perspective view from below of a second body of the closure of FIG. 1 in isolation.
Figure 4:
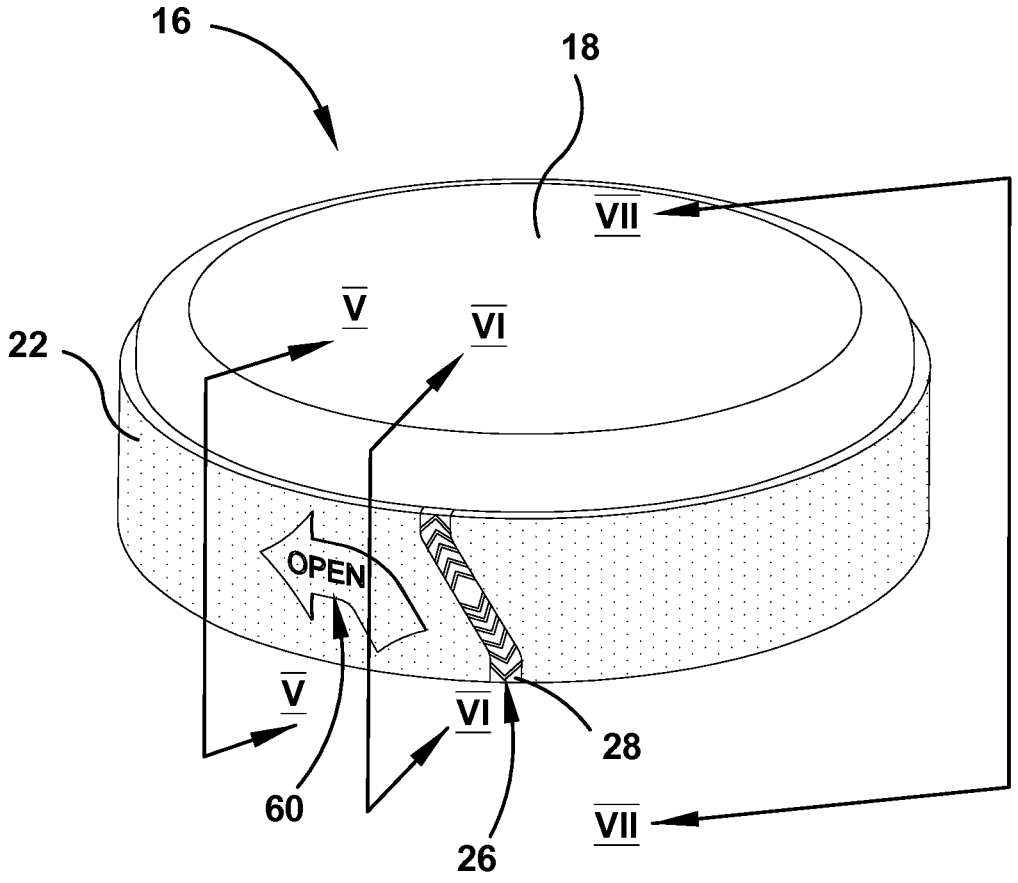
FIG. 4 is a schematic perspective view from above of the closure of FIG. 1 in isolation.
Figure 5:
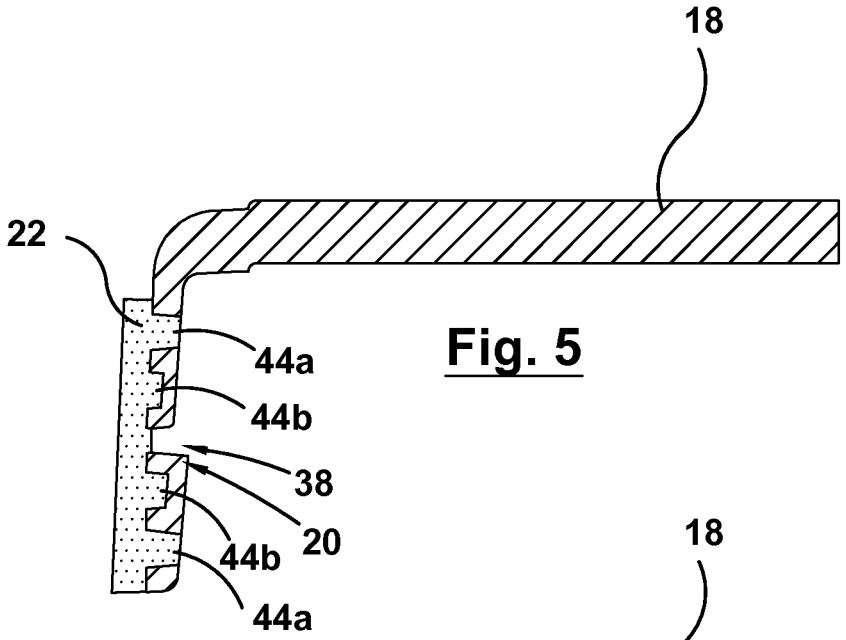
FIG. 5 is a schematic half-section along the line V-V of FIG. 4.
Figure 6:
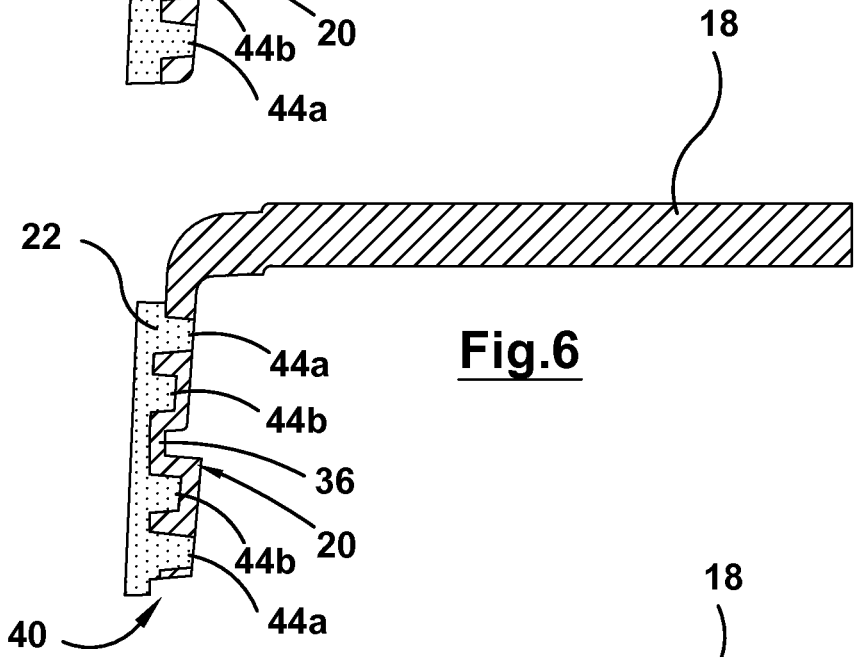
FIG. 6 is a schematic half-section along the line VI-VI of FIG. 4.
Figure 7:
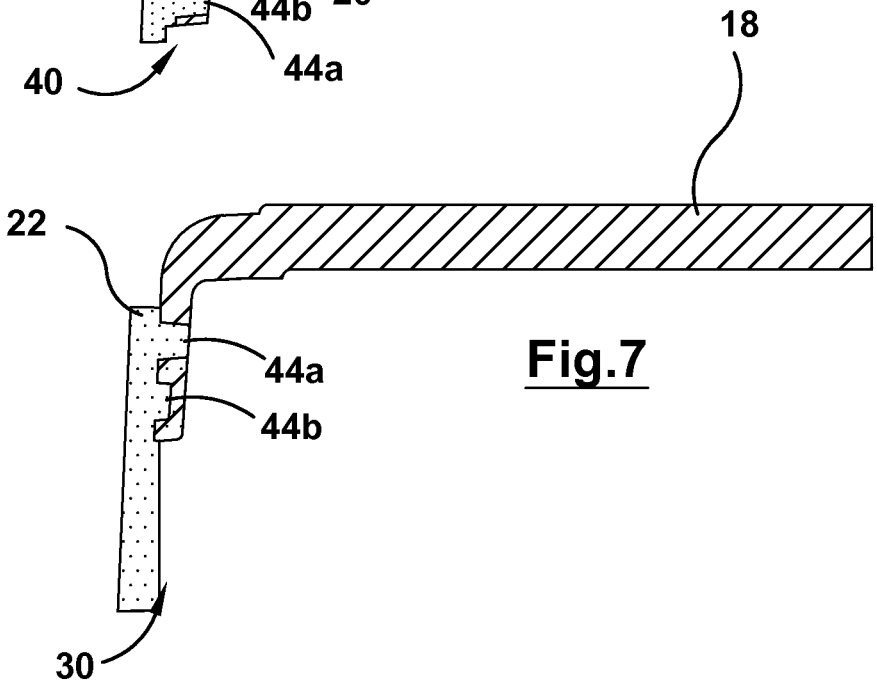
FIG. 7 is a schematic half-section along the line VII-VII of FIG. 4.
Figure 22:
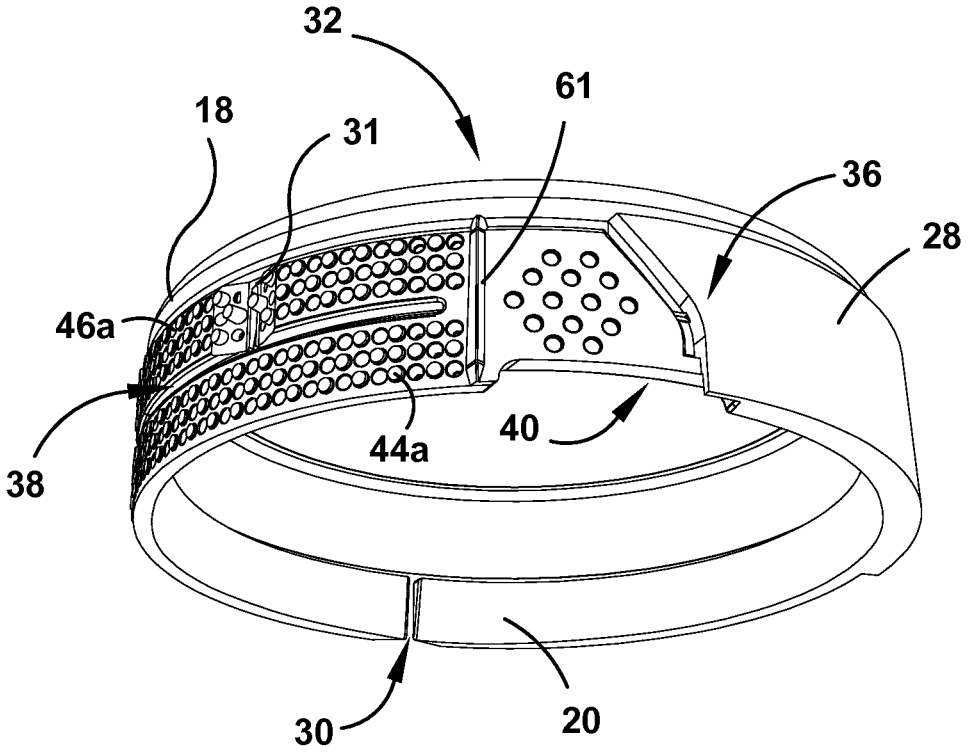
FIG. 22 is a schematic view similar to FIG. 2, but showing a first body of a seventh embodiment of closure in isolation.

Referring to FIGS. 2 and 22, as mentioned previously a third region 28 of the fastener portion 20 may have a greater wall thickness than, for example, the remainder of the fastener portion 20. The third portion 28 may correspond to the position of the discontinuity, e.g. gap and/or frangible region 26, in the split-ring or partial-ring form of the bracing portion 22 (FIGS. 3 and 23). The increased wall thickness may compensate for the reduction in support provided by the bracing portion 22. The third region 28 may optionally correspond to the connection region 36 between the fastener portion 20 and the cover portion 18.

The frangible region 26, if provided, may optionally have a form that is partly extensible and/or compressible (e.g. in the circumferential direction), to compensate for variations in shrinkage of the bodies 32 and/or 34 during and/or after moulding. Plastics may shrink during and/or after moulding, and the degree of shrinkage may also vary, even 40 for the same plastics. For example, polypropylene may shrink by about 1.5%, but the degree of shrinkage may vary anywhere between about 1% and about 3%, sometimes even more. By providing the frangible region 26 in a form that is able to extend and/or compress (e.g. in the circumferential direction), the second body 32 can self-adjust to size variations and moulding tolerances of the mould parts during manufacture, without breaking the frangible region 26. One example of a moulding operation, and the contribution of the frangible region portion 26, is described later below.

The frangible region 26 may, for example, comprise one or more (optionally two or more) frangible connections having the form of a V or U, or other bent or folded shape that is able to unbend or unfold to extend in circumferential length and/or able to collapse, or to bend or fold more tightly, to compress in circumferential length. Therefore, during manufacture and in normal use, the frangible region 26 defined by such connections is unlikely to break accidentally as a result of size variations and/or circumferential stress.

Referring to FIGS. 2, 3, 9, 22 and 23, the position of the split 30 in the fastener portion 20 may be seen, in this example, to be positioned circumferentially relatively far from the third region 28, at least in the peel direction of the bracing portion 22. For example, the split 30 may be spaced around the circumference by an angle 50 of at least 180 degrees, optionally at least 200 degrees, in the peel direction from the third region 28.

As best seen in FIGS. 2 and 22, the third region 28 may also include a slight recess 40 in the axial direction, to provide space for a user to insert a finger tip behind the bracing portion 22 at that point, (e.g. optionally for breaking the connection region 36 if provided, using leverage in a radially outward direction) to initiate peeling of the bracing portion 22. Optionally, the closure 16 may bear indicia 60 to indicate the position and/or manner of opening.

Additionally or alternatively, the bracing portion 22 may include a dedicated pull tab region, e.g. corresponding to the region of the indicia 60 in the drawings. A hinge line 60*a* may permit the pull tab region to flex outwardly to provide a pull tab that may be gripped easily. The hinge line 60*a* may optionally be a living hinge formed, for example, by a thinned region of the bracing portion 22. The thin region would be sufficiently thin to permit flexing of the material, while still sufficiently strong to permit pulling on the tab portion to begin peel the bracing portion 22. In the case of multi-shot moulded first and second bodies, the first body 32 may include an axial ridge (e.g. 61 in FIG. 22) complementary to the hinge line 60*a*.

Figure 8:
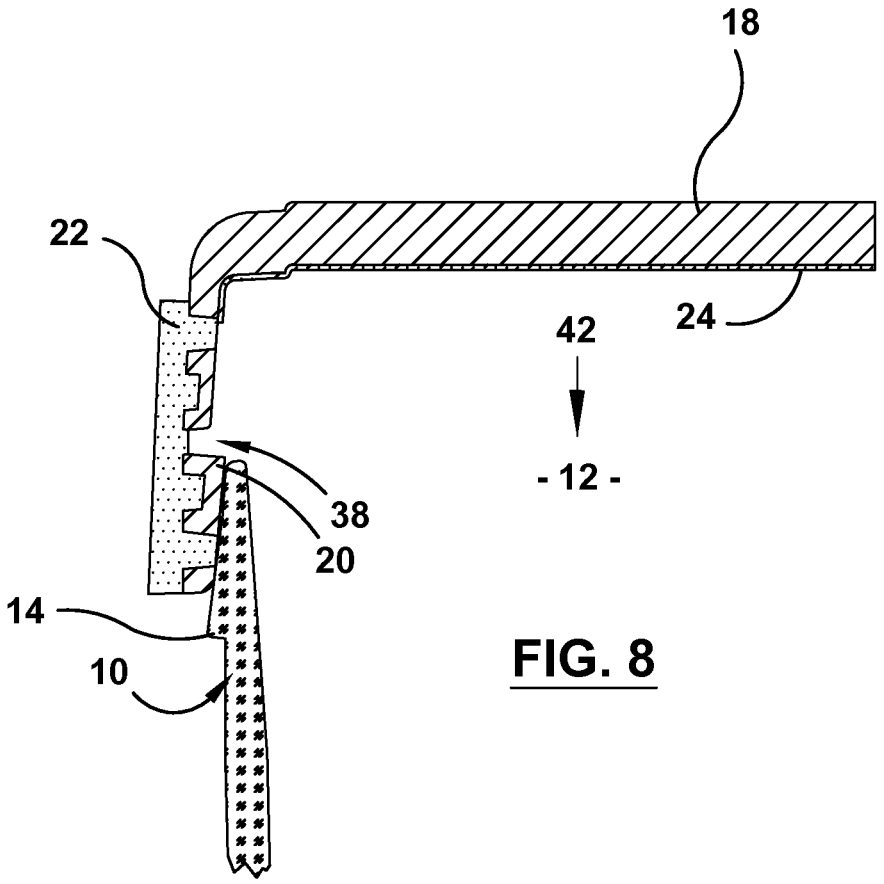
FIG. 8 is a schematic cross section similar to FIG. 5, but illustrating fitting to the container mouth.

Referring to FIG. 8, the closure 16 may be fitted to the container 10 using any desired technique, including standard fitting or capping operations, for example, by a press-fit. The closure 16 may be sufficiently strong and resilient to permit press-fitting in the direction of arrow 42.

Figure 9:
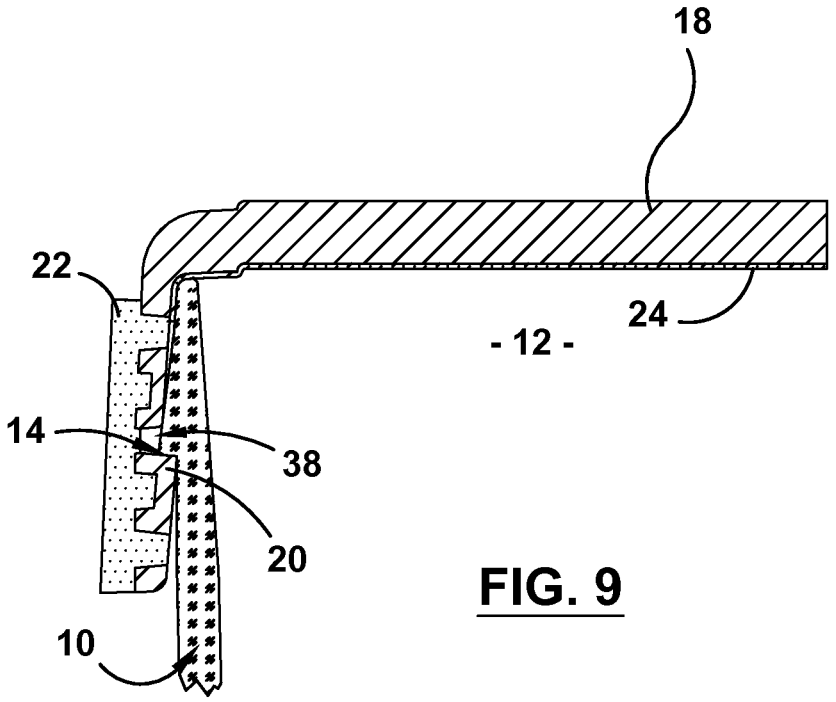
FIG. 9 is a schematic cross-section similar to FIG. 8, but showing the closure in a fully fitted condition.
Figure 9A:
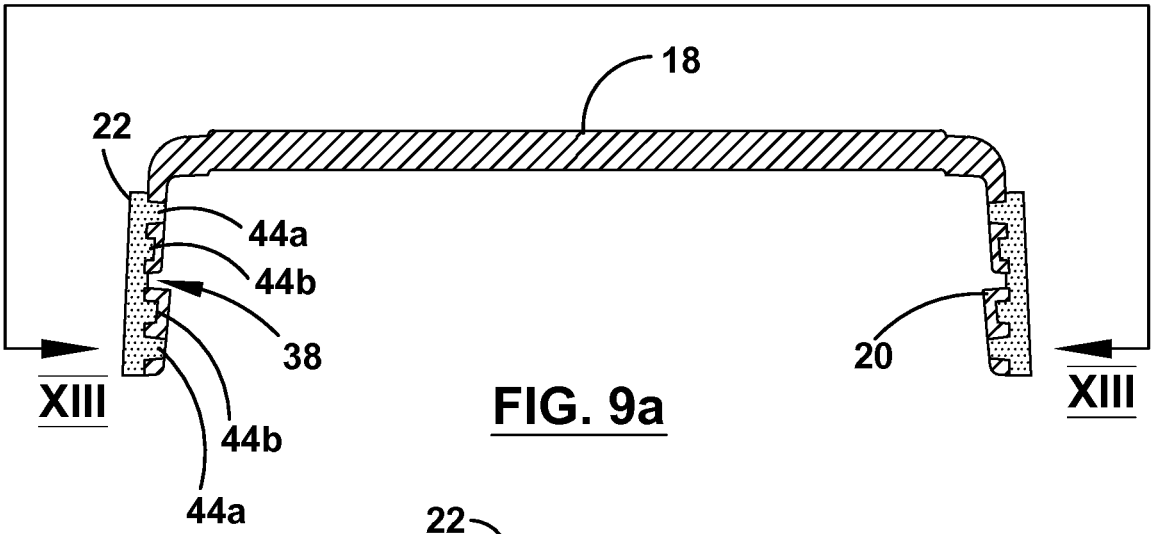
FIG. 9*a* is a general schematic cross-section through the closure of FIG. 4.

Referring to FIG. 9, in the fitted condition, the fastener portion 22 may engage the container 10, for example, by the fastening profile 14. The seal 24 of the cover portion 18 may be held in sealing contact with the container mouth 12. The bracing portion 22 may anchor the cover portion 18 relative to the fastener portion 20, and/or may support or reinforce the fastener portion 20 around the braced/reinforced first region. The closure 16 may be able to withstand the high forces exerted on the closure at the wide mouth 12 by pressurized container contents.

Figure 10:
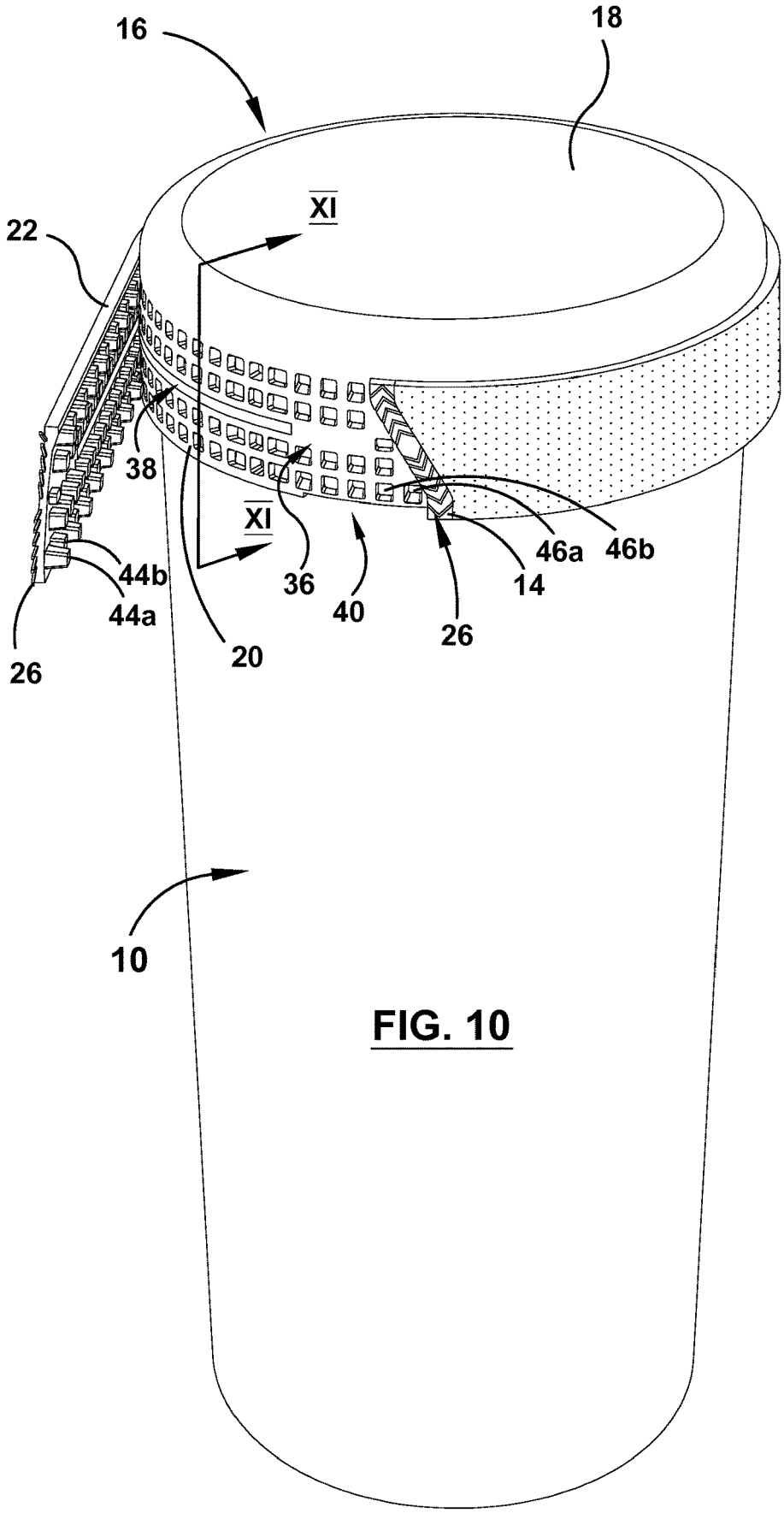
FIG. 10 is a schematic perspective view similar to FIG. 1, but showing the closure in a first partly-peeled "venting" condition, and illustrating certain principles of the disclosure.

Referring to FIG. 10, and as described previously, the closure 16 may be released by inserting a finger tip into the recess 40 to lever the bracing portion 22 (e.g. at the frangible region 26 if provided, and break the frangible connections defining the frangible region 26) and to initiate peeling of the bracing portion 22.

Figure 11:
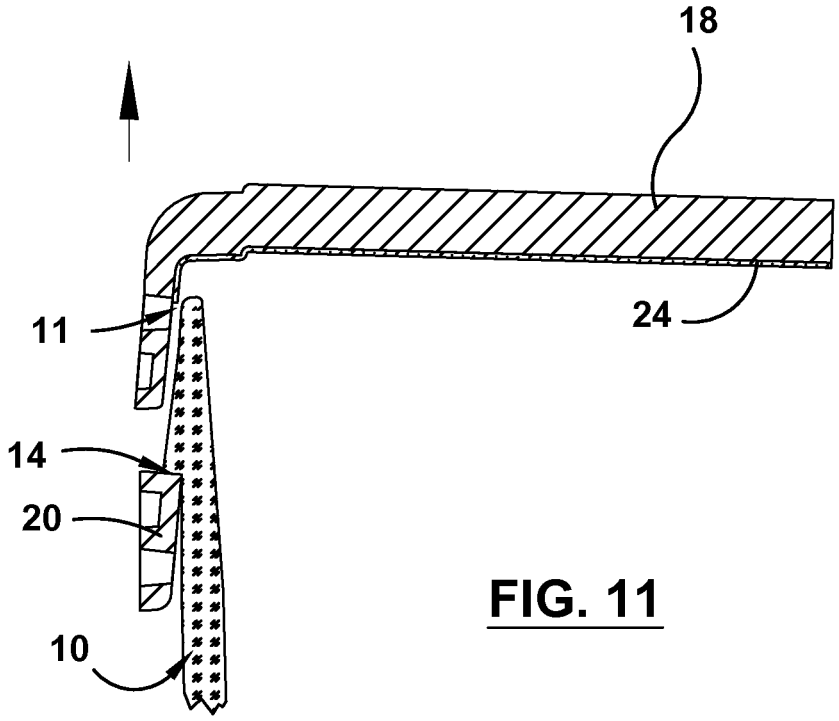
FIG. 11 is a schematic cross-section along the line XI-XI of FIG. 10.

Referring to FIGS. 10 and 11, and as described previously, initial peeling of the bracing portion 22 may relax the anchoring of the cover portion 18 to the fastener portion 20 locally where the bracing portion 22 is peeled away. The cover region 18 may be configured to be permitted to deform or displace under the internal pressure of the container contents, such that the seal 24 lifts to allow pressure to escape.

Figure 11A:
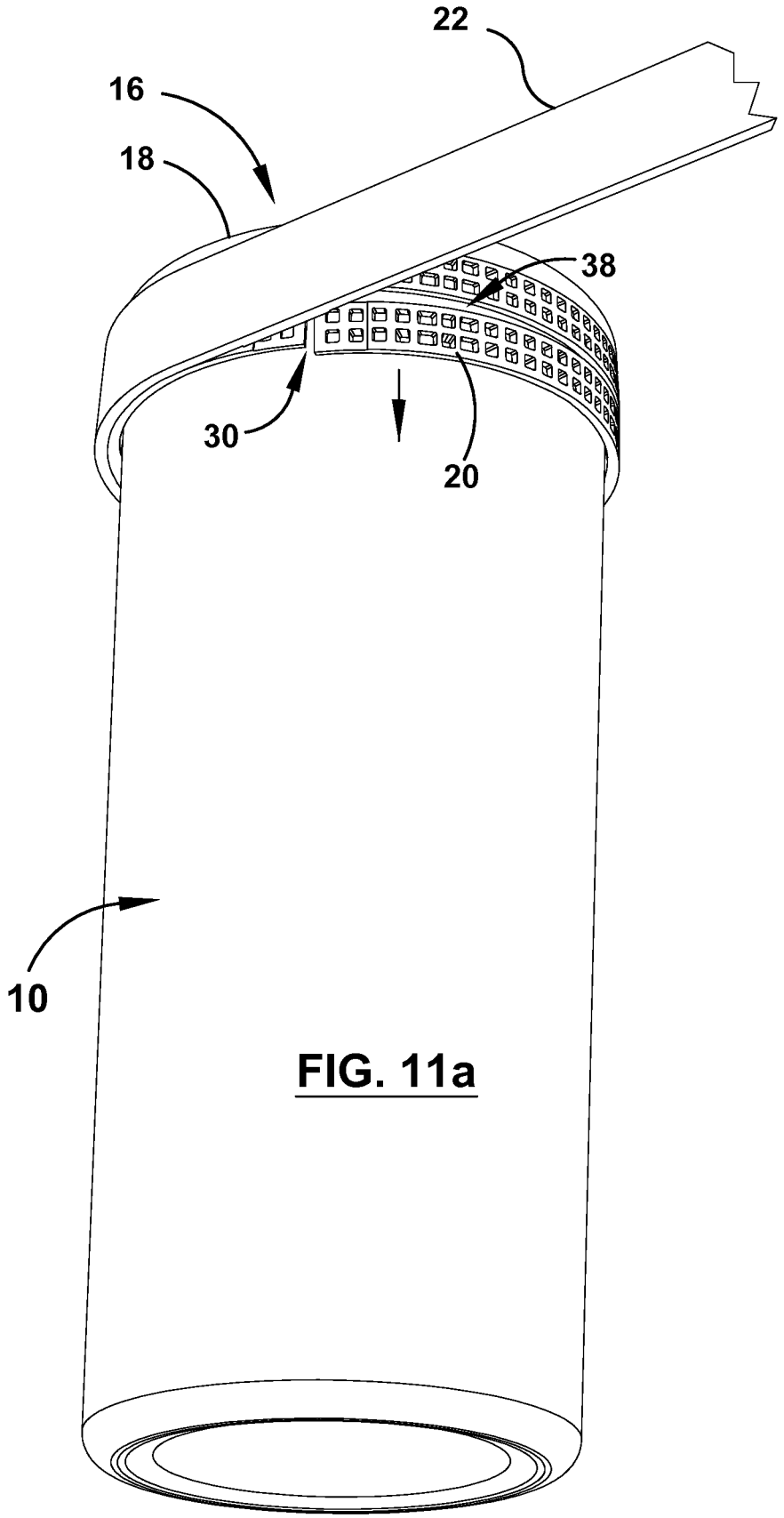
FIG. 11*a* is a schematic underside perspective view showing the closure in a further peeled condition ready for opening.

Referring to FIG. 11*a*, and as described previously, continued peeling of the bracing portion 22 may unbridge the split 30 in the fastener portion 20, thereby permitting the fastener portion 22 to expand, and be disengaged relatively easily by hand from the container 10. Additionally or alternatively, the cover portion 18 may be disengaged from the fastener portion 20 around a majority of the circumferential periphery of the closure 16, thereby allowing the cover portion 18 to, for example, at least partly hinge open to provide a dispensing opening through the closure, whether or not the closure 16 is removed from the container.

In the embodiments illustrated generally in FIGS. 1-15, 22 and 23, the interface between the bracing portion 22 and the cover portion 18, and/or between the bracing portion 22 and the fastener portion 20 may be provided by interfitting or mating surface profiles capable of bearing shear stress at the interface.

For example, the surface profiles may comprise interpenetrating male features (e.g. any of ribs, teeth, bosses and/or barbs), or an arrangement of male features 44 (e.g. any of ribs, teeth, bosses and/or barbs) and female features 46 (e.g. any of apertures, recesses and/or sockets). In the drawings, some of the male features may be illustrated as 44*a* and 44*b*, and some of the female features may be illustrated as 46*a* and 46*b*. In some embodiments comprising both male and female features, one surface profile may generally comprise the male features 44 and the other may generally comprise the female features 46. Alternatively, in some other embodiments each surface profile may comprise a mix of both male and female features 44 and 46 (e.g. see FIGS. 22 and 23). As described below, providing male features 44 on (e.g. at least) the outer body 34 may provide manufacturing advantages. Additionally or alternatively, providing male features 44 on (e.g. at least) the body 34 that is moulded first may provide manufacturing advantages.

In some embodiments, the surface profiles may interfit and/or mate in such a manner as to block, in both an axial direction and a circumferential direction, relative movement between the bracing portion 22 and the cover portion 18 and/or between the bracing portion 22 and the fastener portion 20. This is different from, for example, a screw-threaded engagement or any other engagement involving or permitting axial, circumferential and/or helical relative movement. The surface profiles may be separable in a radial direction, for example, upon peeling of the bracing portion In some embodiments, the surface profiles may comprise respective networks of plural male and/or female features 44 and 46 extending or distributed both circumferentially and axially (e.g. in a two dimensional array). For example, each network may comprise a plurality of male and/or female features 44 and 46 provided at different positions in the circumferential direction, and a plurality of male and/or female features 44 and 46 provided at different positions in the axial direction.

The male and female features 44 and 46 may be of any desired cross-section shape, for example, rectangular, or square, or round, or oval, or any other shape. The cross-section shape may also vary around the circumference, and/or multiple cross-section shapes may be used. By way of example only, FIGS. 2 and 3 illustrate male and female features of generally square section, and FIGS. 22 and 23 illustrate male and female features of generally round section.

Figure 9B:
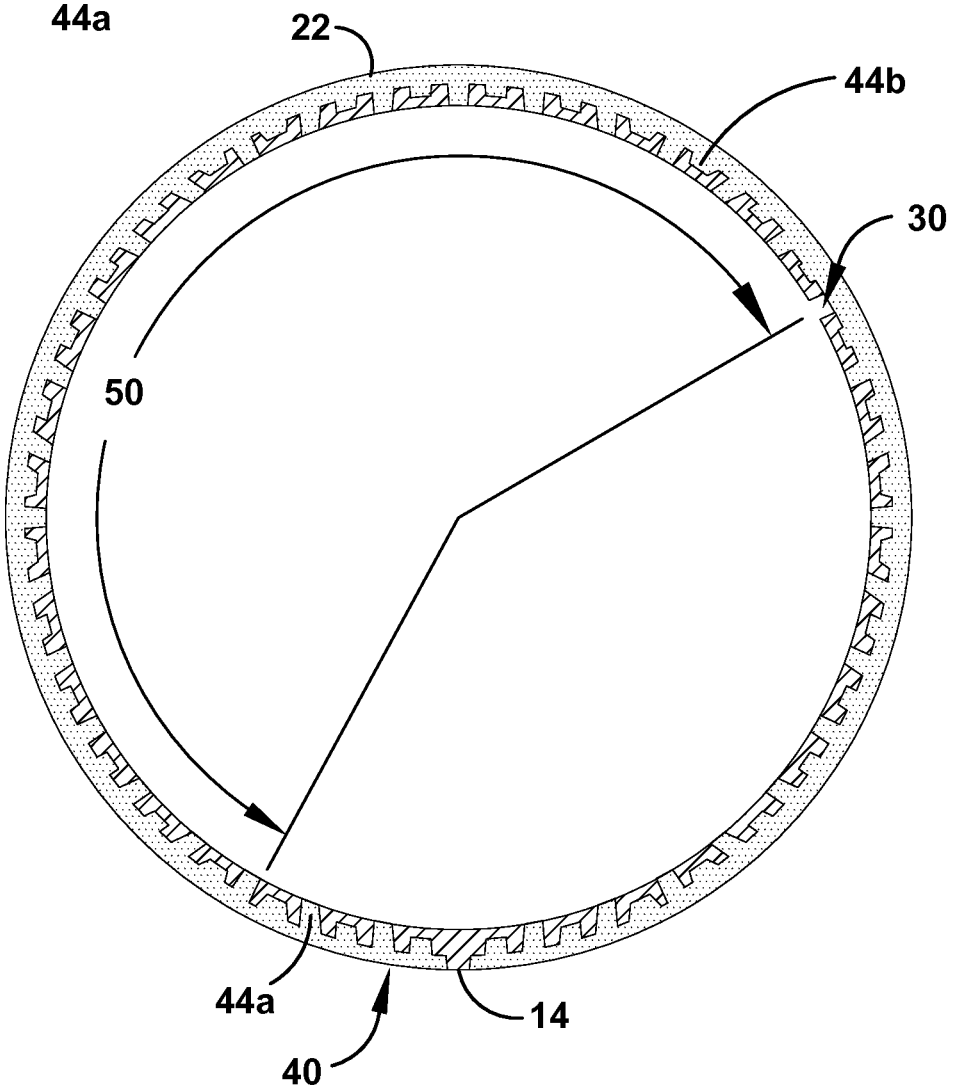
FIG. 9*b* is a schematic cross-section along the line XIII-XIII of FIG. 9*a*.

As best seen on FIG. 9*b*, in some embodiments, at least some of the features of the surface profiles may be aligned generally obliquely to a radial direction or radial plane. In some embodiments, the magnitude and/or direction of the alignment angle with respect to a radial direction or plane may vary amongst at least some of the features. In some embodiments, the variation of the magnitude and/or direction of the alignment angle may repeat circumferentially and/or axially amongst groups of the features around the circumference of the closure. As explained previously, such alignment may be one technique used to bind the bracing portion 22 partly to the fastener portion 20 and/or to the cover portion 18, such that a positive peel force (e.g. modest peel force) has to be applied to overcome the binding effect of the surfaces, and continue the peeling progressively; the bracing portion 22 may not peel freely and/or uncontrollably once peeling has been initiated.

As may be seen in FIGS. 5 to 9, in some embodiments, at least some of the features of the surface profiles may have different radial extents from one another. In some embodiments, at least one of the features 44*a*/46*a* may have a first radial extent, and at least one other of the features 44*b*/46*b* may have a second radial extent different from the first. The radial extent may optionally be referred to as a radial "height" for a male feature 44, or may optionally be referred to as a radial "depth" for a female feature 46. In some embodiments, at least one (and optionally at least a first plurality) of the features may have the first radial extent, and at least one other (and optionally at least a second plurality) of the features may have the second radial extent.

In some embodiments, the first plurality of features may include apertures 46*a* having a radial extent (e.g. radial depth) optionally extending radially substantially entirely through a wall of a respective portion of the closure (for example, any of the cover portion, the fastener portion, and/or the bracing portion), and the second plurality of features may include recesses 46*b* having a radial extent (e.g. radial depth) that does not extend entirely through the wall of the respective portion.

Similarly, the first plurality of features may include projections 44*a* having a radial extent (e.g. radial height) optionally extending radially substantially entirely through a wall of a respective counterpart portion engaged by the projection 44*a*, for example, an aperture 46*a* described above. The second plurality of features may include projections 44*b* having a radial extent (e.g. radial height) extending only partway through or into a wall of a respective counterpart portion engaged by the projection 44*b*, for example, an aperture 46*b* described above. FIGS. 22 and 23 illustrate male and female features of different radial extends on both bodies.

As will be explained below, the use of different radial extents of male and female features 44 and 46 may facilitate moulding using a multi-shot moulding process.

Figure 12:
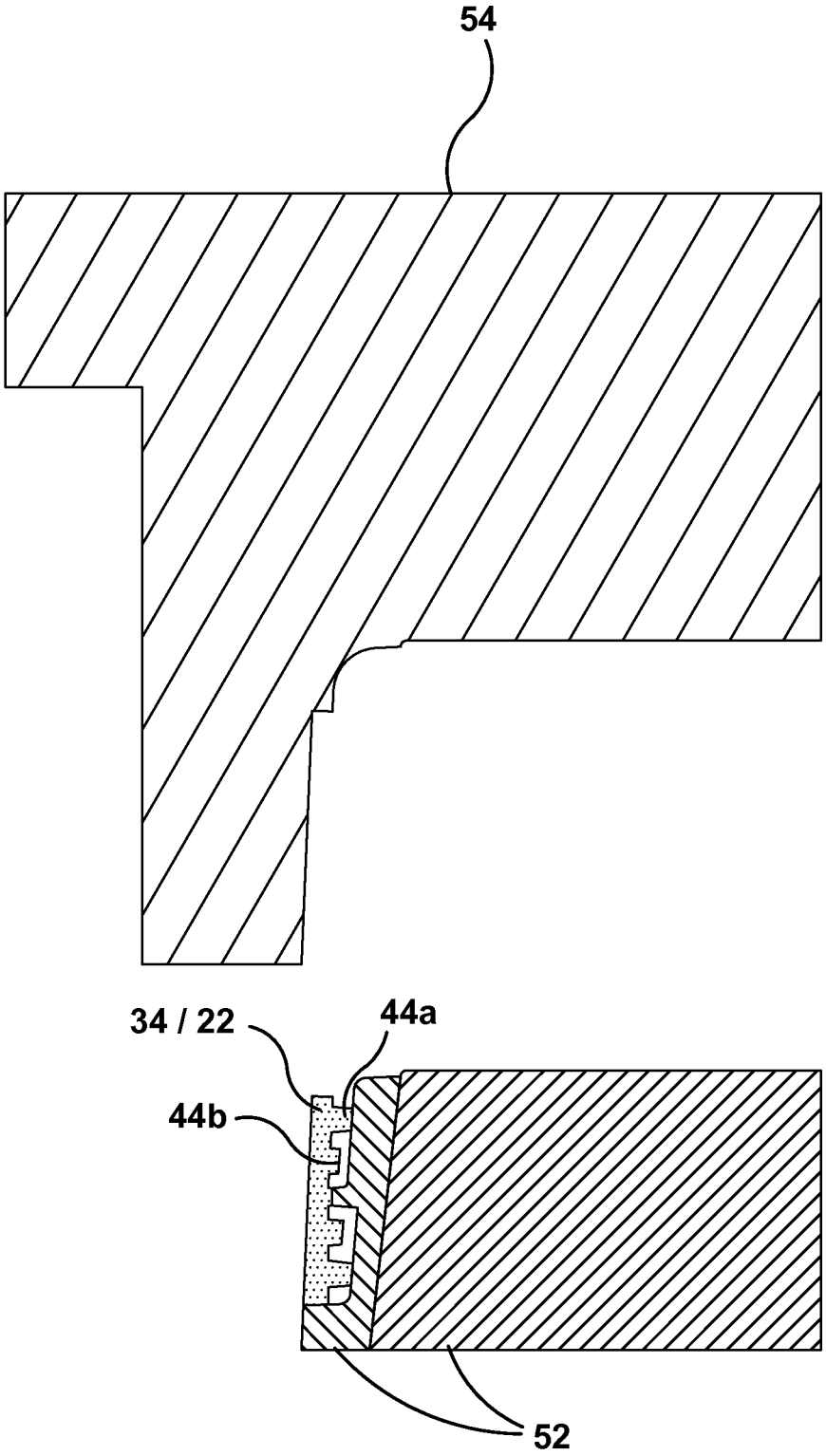
FIGS. 12-15 are schematic sectional views illustrating a sequence for moulding the closure.
Figure 13:
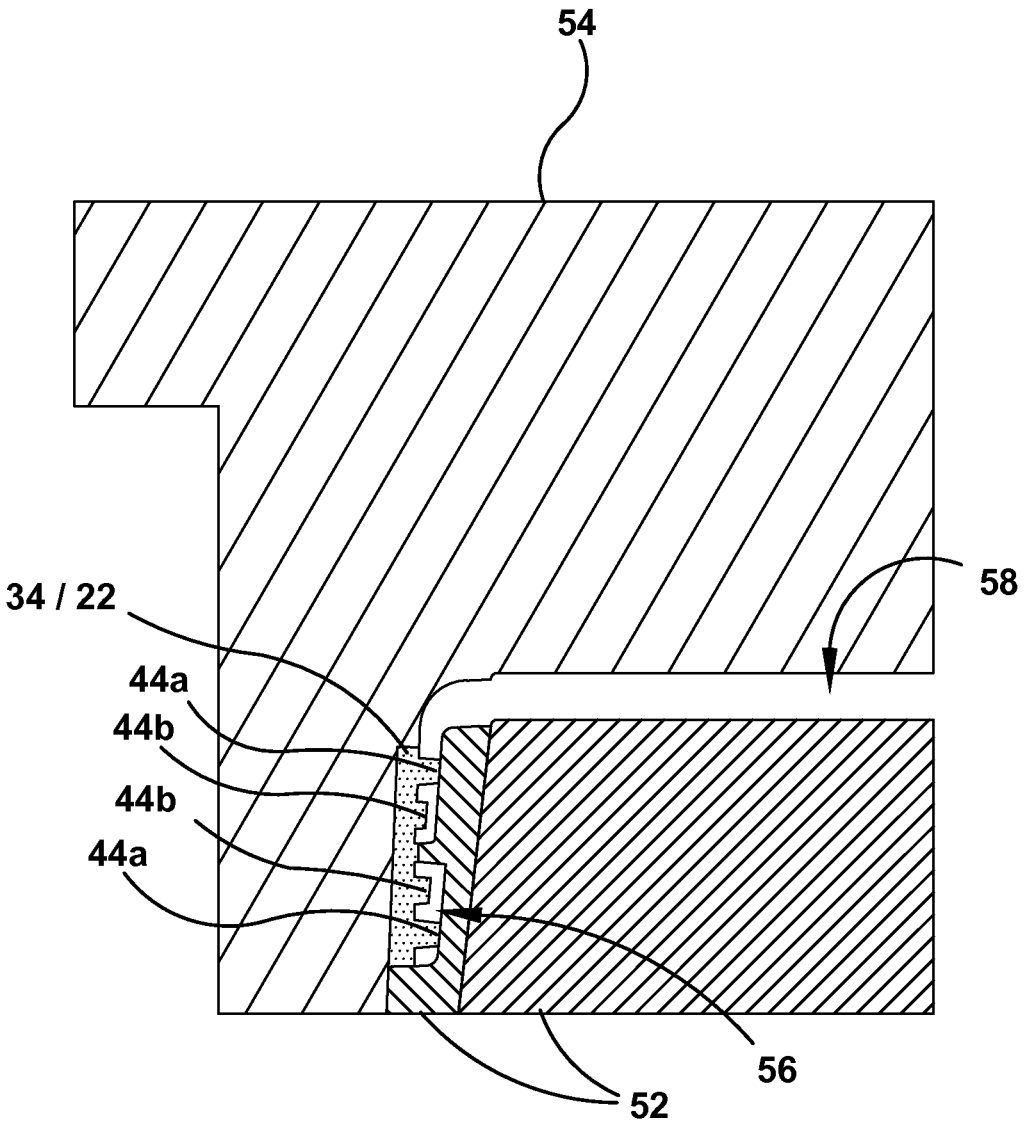
Figure 14:
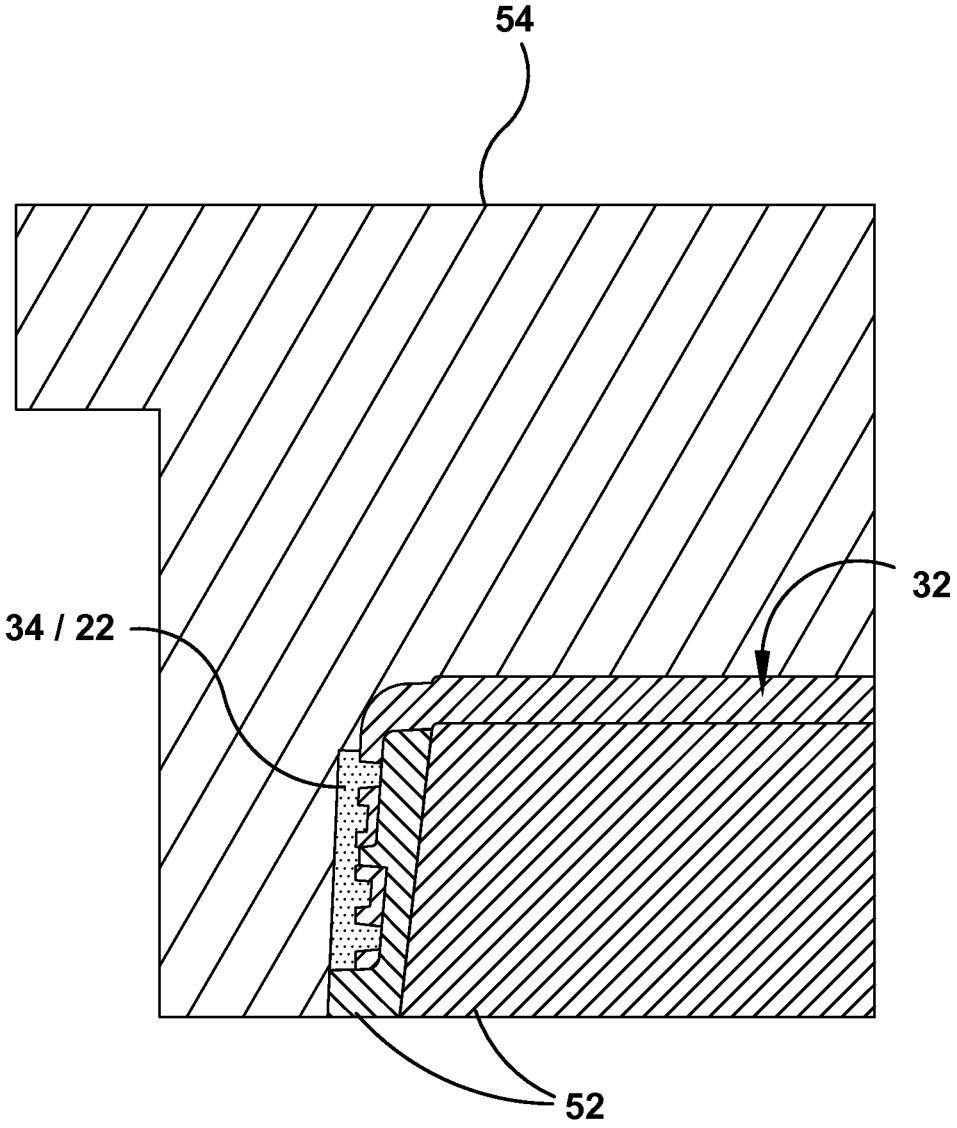

Referring to FIG. 12, one example moulding technique is now illustrated, although this does not limit the scope of the present disclosure, and other moulding techniques may be used as desired. In a first moulding operation, the second body 34 (e.g. the bracing portion 22) is moulded, for example, using a standard mould tool (not illustrated in FIG. 12). The second body 34 may include the male features 44 described above, including features 44*a* of a first radial height greater than features 44*b* that are also provided.

The moulded second body 34 may then be transferred to a second mould (FIGS. 12-15) for a second moulding operation to mould the first body 32 on to, and in intimate contact with, the second body 34. Such a technique may be referred to as "over-moulding" (or even "under-moulding" because the first body 32 is moulded inside the pre-moulded second body 34). The second mould may include an inner mould part 52 and an outer mould part 54 that enclose the pre-moulded second body 34. The shape of the first body 32 being moulded is defined by free spaces 56 and 58 into which plastics is injected. The depending wall of the first body 32 is defined by the free space(s) 56 between the second body 34 and the inner mould part 52. The top wall of the first body 32 is defined by the free space 58 between the mould parts 52 and 54. The radially tall male features 44*a*, and/or other features of the second body 34, act as spacers to ensure that the second body 34 is seated against the outer mould part 54, and that the free space 56 is, as intended, entirely radially inward of the second body 34. The less tall male features 44*b* enable the first body 32 to have greater material strength than were the first body 32 to be formed entirely with apertures extending all of the way through the material wall.

As explained previously, the frangible region 26 is configured to accommodate circumferential expansion and/or compression of the body 34, without breaking the frangible region 26. This provides advantages in an intimate moulding operation as described above. The plastics used for moulding the body 32 and/or the body 34 may shrink during/after moulding. The ability of the frangible region 26 to accommodate circumferential expansion and/or compression permits the second body 34 to self-adjust to the size of the mould parts used (for example, the mould parts 52 and 54 may be slightly oversize to compensate for expected plastics shrinkage). Manufacturing tolerances can be relaxed allowing for easier manufacture and/or improved yield.

Also as explained previously, at least the second body 34 includes male features, e.g. teeth 44. When the first body 32 is subsequently moulded in intimate contact around the teeth 44, the plastics of the first body 32 may shrink during/after moulding. Such shrinkage may cause the thus-created apertures 46 of the first body to shrink-down and grip, at least to some extent, the teeth 44. This can further enhance maintenance of the intimate contact between the first and second bodies 32 and 34 despite shrinkage of the plastics of the later-formed first body 32. It can also contribute to preventing unwanted peeling of the bracing portion 22.

Figure 15:
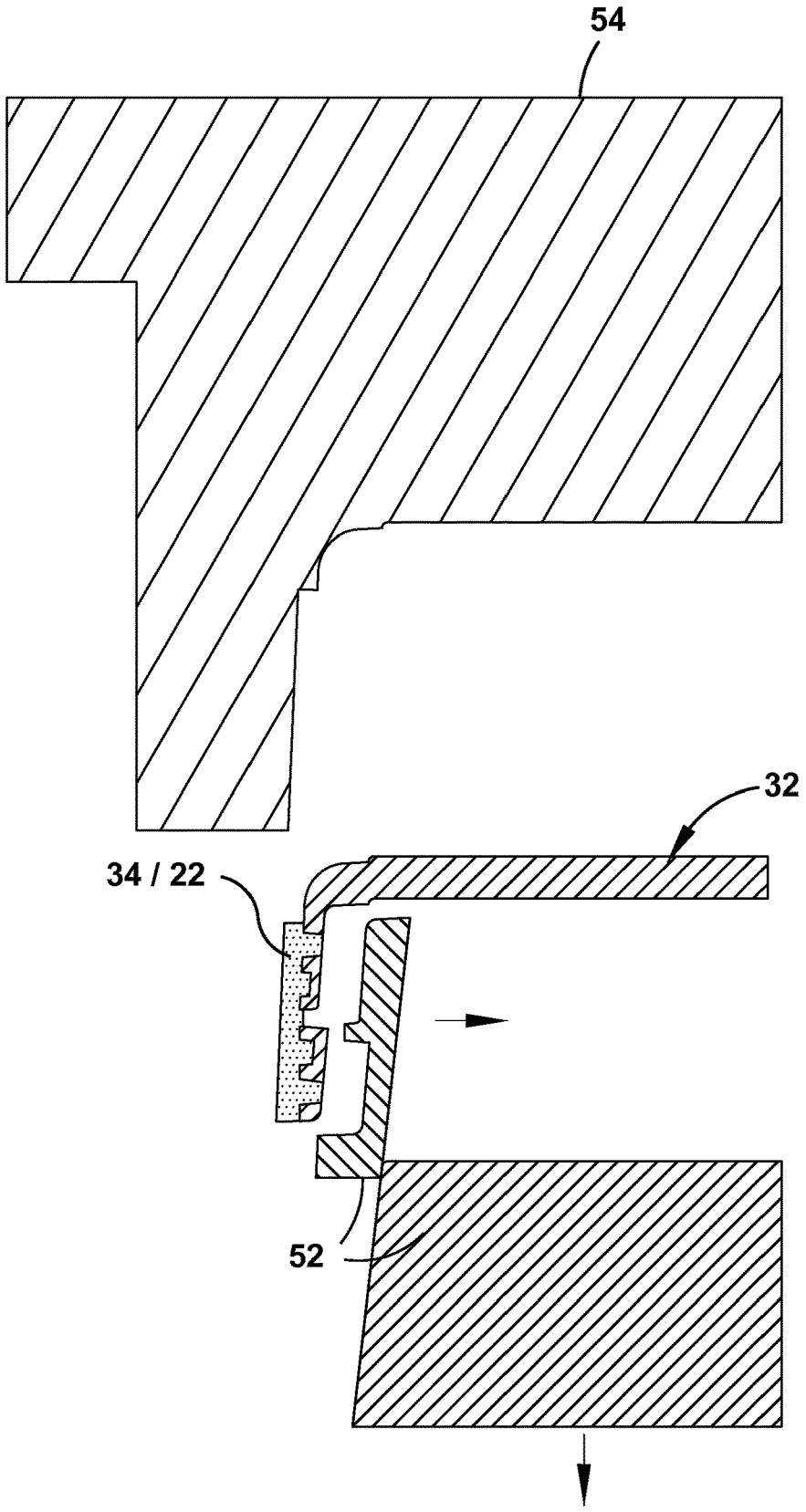

Referring to FIG. 15, after the moulding operation has been complete, the inner and outer mould parts 52 and 54 may be opened to reveal the moulded closure 16 consisting of the first and second bodies 32 and 34 in intimate contact. The inner mould part 52 may, for example, be in the form of a multi-part collapsing core, with different segments that are able to be withdrawn in different directions, to facilitate removal of the closure 16 without damaging the interior closure surface.

The first and second bodies 32 and 34 may optionally be of different plastics materials that do not adhere strongly together during the multi-shot moulding operation, thereby to provide a peelable bracing portion 22. Alternatively, the first and second bodies 32 and 34 may optionally be of the same or similar plastics material, and the moulding operation carried out under controlled conditions to avoid the bodies 32 and 34 adhering together too strongly. For example, one of the mould parts 52 and 54 may be highly cooled to prevent such adhesive attachment.

Whatever moulding process may be used, example plastics materials) suitable for the closure may include, but are not limited to, any one or more of: polypropylene; polyethylene; polyethylene terephthalate (PET).

Figure 16:
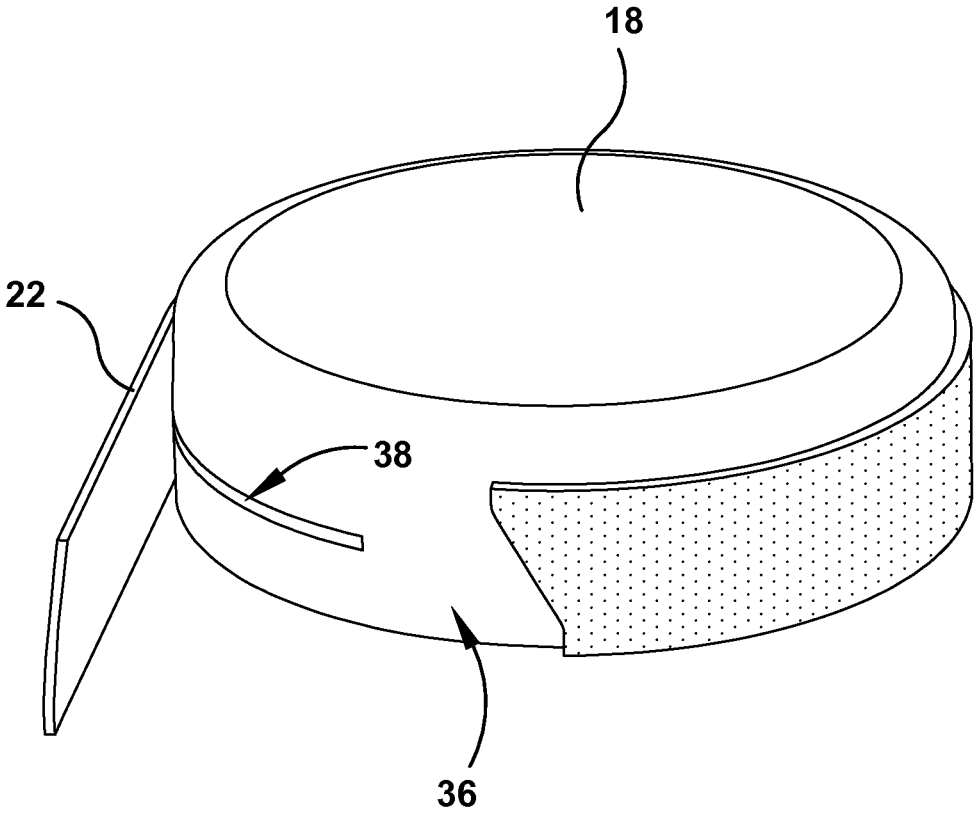
FIG. 16 is a schematic perspective view of a second embodiment of closure in isolation.

FIG. 16 illustrates a second embodiment similar to the above embodiment, except that the interface profile for the bracing portion 22 does not include interfitting male and female features. Instead, the second body 34 and/or the bracing portion 22 is adhered to the first body 32 using a peelable adhesive. The peelable adhesive is able to bear shear stress at the interface in order to support and/or reinforce the cover portion 18 and fastener portion 22, and/or to anchor the cover portion 18 to the fastener portion 20. The function and operation of the closure of this embodiment may include any of the other features previously described.

FIGS. 17 and 18 illustrate a third embodiment similar to the embodiment of FIG. 16, except that the cover portion 18, the fastener portion 20 and the bracing portion 20 are formed from a laminate material. A first inner layer of the laminate material may, in a similar manner to, or corresponding to, the first body 32 described above, provide the cover portion 18 and the fastener portion 20. A second outer layer of the laminate may, in a similar manner to, or corresponding to, the second body 34 described above, provide the bracing portion 22.

The laminate may, for example, be formed by any suitable process, such as thermoforming.

The laminate form of closure 16 may, in some embodiments, be fitted to the container 10 by a thermal-shrink process, for example, a heat-shrink process. Referring to FIG. 16, the laminate closure may initially be large enough to be slipped over the container mouth 12 without significant application pressure. Referring to FIG. 18, the thermal-shrink process may collapse the closure tightly against the container.

As described previously, the example of FIGS. 17 and 18 (and also the example of FIG. 19 described just below), is an example also illustrating the second body extending at least partly, and optionally entirely, over the top wall of the first body, as an outer shell 62 of the closure. A discontinuity 64, may divide the bracing portion 22 from the remainder of the shell 62. The discontinuity 64 may, for example, be an at least partly circumferentially extending gap or region of weakness to allow the bracing portion 22 to be peeled without disturbing and/or without being substantially hindered by, the top wall.

Figure 19:
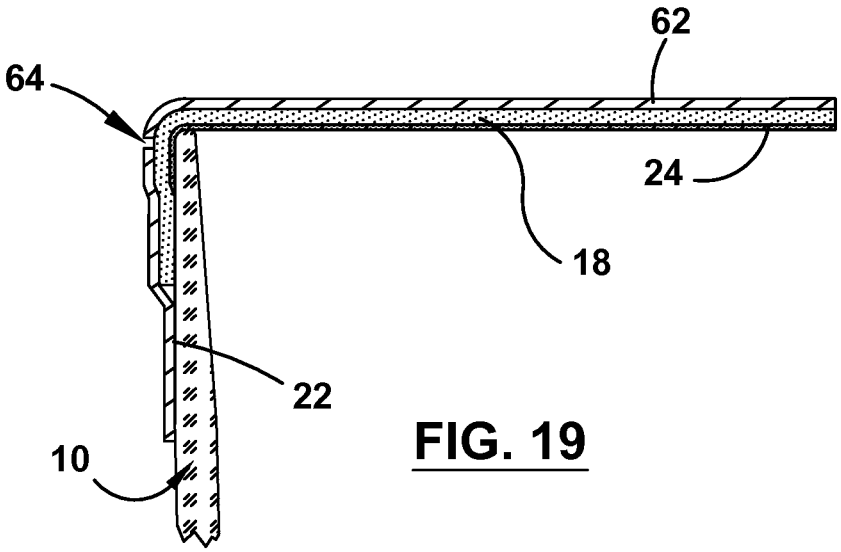
FIG. 19 is a schematic cross-section showing a fourth embodiment of closure fitted to a container.

Referring to FIG. 19, in some embodiments, the fastener portion 22 may be omitted. Instead, the bracing portion 22 may directly engage the container. For example, the bracing portion 22 may carry an adhesive for adhesively engaging the exterior of the container 10 around the mouth 12. The closure 16 may be fitted using a thermal-shrink process for shrinking the closure into adhesive engagement with the container 10. The bracing portion 22 may be peelable progressively, and provide the same or equivalent venting and release operation described above.

Figure 20:
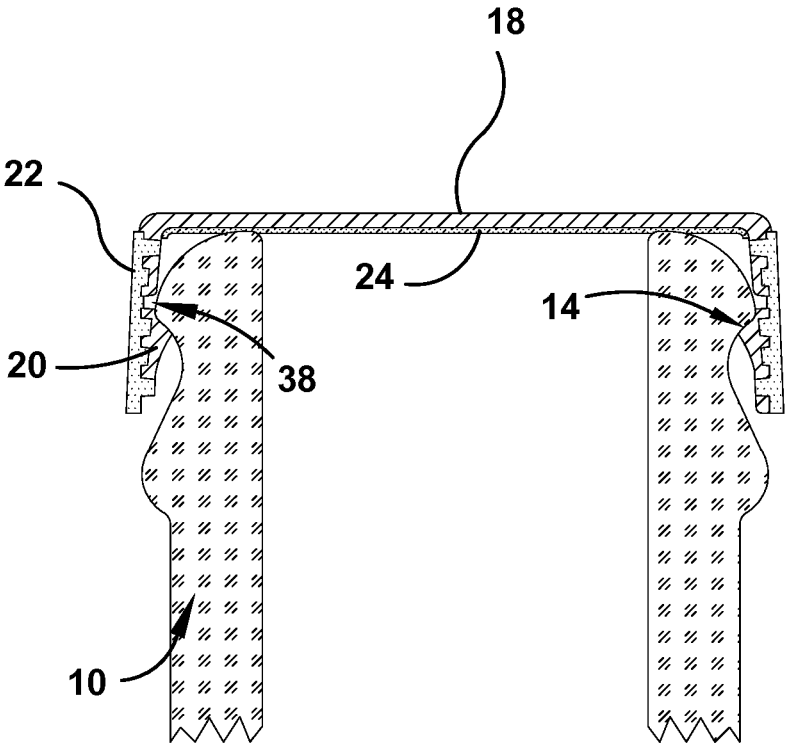
FIG. 20 is a schematic cross-section showing a fifth embodiment of closure fitted to a conventional bottle mouth.

FIG. 20 shows a closure similar to that of FIGS. 1-15, but fitted to a conventional bottle mouth with a fastener recess 14 normally intended for a metal crown closure (e.g. a "crown cork"). The fastener portion 20 may include an inwardly projecting lip or lug shaped to firmly engage the recess 14. The closure 16 may provide the same pressure retention, venting, and release operation described above, and enable a bottle to be opened easily by hand, without having to use a separate tool such as a crown cork bottle opener.

Figure 21:
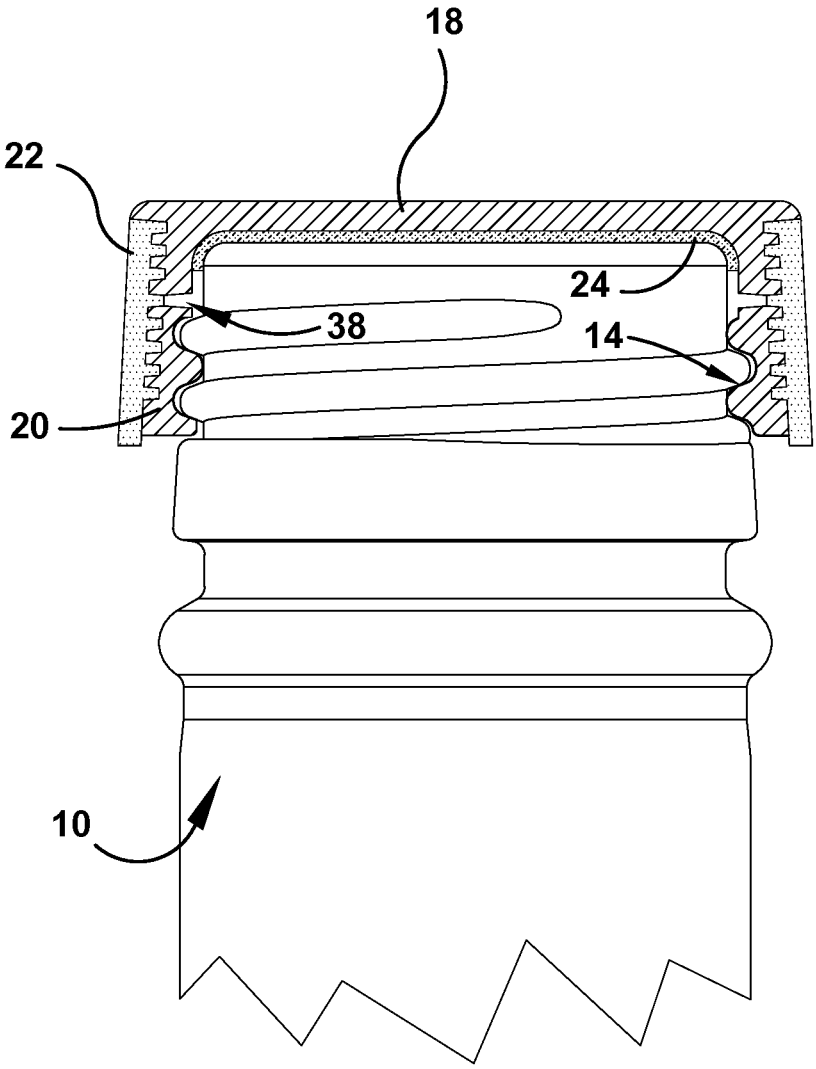
FIG. 21 is a schematic cross-section showing a sixth embodiment of closure fitted to a conventional screw-threaded bottle mouth.

FIG. 21 shows a closure similar to that of FIG. 20, except that the closure is fitted to a screw-threaded container mouth, having a fastening profile 14 in the form of a screw thread. The container mouth may have a diameter of at least 60 mm, or it may have a diameter less than 60 mm. The drawing illustrates a conventional bottle mouth, but the container may have other forms, such as a jar. The container may, for example, be of plastics or glass. The fastener portion 20 may include a complementary thread shaped to engage the fastening profile 14. The closure may optionally have the height of a conventional screw-threaded closure, and may be compatible with conventional bottling apparatus for screw threaded closures. The closure may provide the same pressure retention, venting and release operation described above. The closure may be released by an unscrewing action or, alternatively, the fastener portion 20 may be removable by pulling free of the container, in a similar manner to preceding embodiments. The screw-threaded example may be advantageous whether or not the container is pressurized, and/or whether the container mouth is large or small. Even large-size screw-threaded closures for non-pressurized containers may be screwed so tightly to the container mouth that they may difficult to remove by hand.

It is emphasized that the foregoing description is merely illustrative of non-limiting example embodiments, and that scope of the disclosure is intended to include all equivalents, modifications and improvements that may be used in accordance with the principles disclosed herein.

The invention claimed is:

1. A closure for a container mouth, the closure comprising:

a cover portion for covering at least a portion of the container mouth;

a fastener portion for engaging the container for fastening the closure to the container; and a bracing portion extending in a circumferential direction of or around an axis of the closure, the bracing portion overlapping at least partly the cover portion and the fastener portion, and configured to reinforce the closure by bearing, as shear stress at an interface between the bracing portion and at least one of the cover portion and fastener portion, support force in or between one or both of the cover portion and the fastener portion, wherein:

the bracing portion is peelable progressively from engagement with at least one of (i) at least a portion of the cover portion, and (ii) at least a portion of the fastener portion, and in a partly peeled condition, shear stress is released around a peeled region of the closure, whereas shear stress is still borne at an interface with the bracing portion around a unpeeled region of the closure.

2. The closure of claim 1, wherein the bracing portion is peelable progressively from engagement with (i) at least a portion of the cover portion and (ii) at least a portion of the fastener portion.

3. A closure for a container mouth, the closure comprising:

a cover portion for covering at least a portion of the container mouth;

a fastener portion for engaging the container for fastening the closure to the container; and a bracing portion extending in a circumferential direction of or around an axis of the closure, the bracing portion overlapping at least partly the cover portion and the fastener portion, and configured to reinforce the closure by bearing, as shear stress at an interface between the bracing portion and at least one of the cover portion and fastener portion, support force in or between one or both of the cover portion and the fastener portion, wherein:

the bracing portion is peelable progressively from engagement with at least one of (i) at least a portion of the cover portion, and (ii) at least a portion of the fastener portion, and when the bracing portion is in a partly peeled state, the cover portion is at least partly released sufficiently to enable venting of pressure.

4. A closure for a container mouth, the closure comprising:

a cover portion for covering at least a portion of the container mouth;

a fastener portion for engaging the container for fastening the closure to the container; and a bracing portion extending in a circumferential direction of or around an axis of the closure, the bracing portion overlapping at least partly the cover portion and the fastener portion, and configured to reinforce the closure by bearing, as shear stress at an interface between the bracing portion and at least one of the cover portion and fastener portion, support force in or between one or both of the cover portion and the fastener portion, wherein the bracing portion bridges a discontinuity between the cover portion and the fastener portion.

5. The closure of claim 4, wherein the or a discontinuity is at least one selected from: a split; a gap; a region of weakness; an extensible region; an expandable region; a distensible region; a frangible region.

6. A closure for a container mouth, the closure comprising:

a cover portion for covering at least a portion of the container mouth;

a fastener portion for engaging the container for fastening the closure to the container; and a bracing portion extending in a circumferential direction of or around an axis of the closure, the bracing portion overlapping at least partly the cover portion and the fastener portion, and configured to reinforce the closure by bearing, as shear stress at an interface between the bracing portion and at least one of the cover portion and fastener portion, support force in or between one or both of the cover portion and the fastener portion, wherein the bracing portion bridges a discontinuity in the fastener portion.

7. The closure of claim 6, wherein the bracing portion is configured to bear support force as shear stress at, at least one of (i) an interface between the bracing portion and the cover portion, and (ii) an interface between the bracing portion and the fastener portion.

8. The closure of claim 6, wherein the bracing portion is configured to anchor the cover portion in a closed condition relative to the fastener portion.

9. The closure of claim 6, wherein the bracing portion is stabilized in the circumferential direction by the cover portion, circumferential stress being at least partly transmitted to the cover portion as shear stress at an interface between the bracing portion and the cover portion.

10. The closure of claim 6, wherein the bracing portion is configured to reinforce the fastener portion in the circumferential direction for maintaining engagement of the closure on a container mouth, and wherein when the circumferential reinforcement of the bracing portion is removed, the fastener portion is manually disengageable from the container mouth.

11. The closure of claim 6, wherein the interface between, at least one of, the bracing portion and the cover portion and between the bracing portion and the fastener portion, comprises interfitting surface profiles capable of bearing shear stress at the interface.

12. The closure of claim 11, wherein the interfitting surface profiles comprise at least one selected from: interfitting male features; interfitting male and female features.

13. The closure of claim 12, wherein a surface profiles comprise respective networks of at least one of male and female features distributed both circumferentially and axially.

14. The closure of claim 11, wherein at least some of a plurality of features of the surface profiles are aligned obliquely to a radial direction or radial plane.

15. The closure of claim 14, wherein at least one of a magnitude and direction of the alignment angle with respect to a radial direction or plane varies amongst at least some of the plurality of features.

16. The closure of claim 15, wherein at least one of the variation of the magnitude and direction of the alignment angle repeats at least one of circumferentially and axially amongst groups of the plurality of features around the circumference of the closure.

17. A closure for a container mouth, the closure comprising:

a cover portion for covering at least a portion of the container mouth;

a fastener portion for engaging the container for fastening the closure to the container; and a bracing portion extending in a circumferential direction of or around an axis of the closure, the bracing portion overlapping at least partly the cover portion and the fastener portion, and configured to reinforce the closure by bearing, as shear stress at an interface between the bracing portion and at least one of the cover portion and fastener portion, support force in or between one or both of the cover portion and the fastener portion, wherein the bracing portion comprises a discontinuity that is bridged over at least a part of the bracing portion length by a portion of at least one of, (i) the cover portion, (ii) the fastener portion and (iii) a connection between the cover portion and the fastener portion.

18. The closure of claim 17, wherein the bracing portion comprises a split-ring or partial-ring band having a discontinuity corresponding to the position of split or gap of a split-ring or partial-ring form.

* * * * *